US009972906B2

(12) United States Patent
Vassilakis

(10) Patent No.: US 9,972,906 B2
(45) Date of Patent: May 15, 2018

(54) TWO-WAY ANTENNA MOUNTING BRACKET AND ASSEMBLY WITH INDEPENDENTLY ADJUSTABLE ELECTROMECHANICAL ANTENNA TILT AND AZIMUTHAL STEERING FOR BEAM RESHAPING

(71) Applicant: OUTTHINK TECHNOLOGIES LLC, Las Vegas, NV (US)

(72) Inventor: Bill Vassilakis, Orange, CA (US)

(73) Assignee: OUTTHINK TECHNOLOGIES, LLC, Las Vegas, NV (US)

( * ) Notice: Subject to any disclaimer, the term of this patent is extended or adjusted under 35 U.S.C. 154(b) by 292 days.

(21) Appl. No.: 14/995,295

(22) Filed: Jan. 14, 2016

(65) Prior Publication Data

US 2016/0211576 A1 Jul. 21, 2016

Related U.S. Application Data

(60) Provisional application No. 62/103,599, filed on Jan. 15, 2015.

(51) Int. Cl.

| | |
|---|---|
| ***H01Q 1/24*** | (2006.01) |
| ***H01Q 1/12*** | (2006.01) |
| ***H01Q 3/08*** | (2006.01) |

(52) U.S. Cl.

CPC ..... *H01Q 3/08* (2013.01); *H01Q 1/125* (2013.01); *H01Q 1/1228* (2013.01); *H01Q 1/1207* (2013.01); *H01Q 1/246* (2013.01)

(58) Field of Classification Search

CPC ..... H01Q 1/125; H01Q 1/243; H01Q 1/246; H01Q 1/1242; H01Q 1/12; H01Q 1/1703; H01Q 3/08; H01Q 3/005

(Continued)

(56) References Cited

U.S. PATENT DOCUMENTS 6,480,168 B1 * 11/2002 Lam ..... H01Q 1/1235 343/805

7,183,996 B2 2/2007 Wensink (Continued)

FOREIGN PATENT DOCUMENTS

JP 02-060305 U 5/1990

JP 2002016424 * 6/2000

(Continued)

*Primary Examiner* — Hoang Nguyen

*Assistant Examiner* — Awat Salih

(74) *Attorney, Agent, or Firm* — Lazaris IP

(57) ABSTRACT

An assembly for a mobile communications antenna system includes a bracket assembly onto which an antenna array is mounted. The bracket assembly includes a steering arrangement configured to provide angular adjustment of an antenna beam azimuth, and an electromechanical tilting arrangement configured to adjust a tilt position of the antenna array. The steering arrangement and the electromechanical tilting arrangement are controllable in remote and manual operational modes to independently and variably adjust both azimuthal angle and tilt position of the antenna array. These operational modes ensure remote control of signal propagation and network coverage accuracy, and manual adjustment of the azimuth of the antenna beam and tilt position of the antenna array in case of field service or component failure.

17 Claims, 14 Drawing Sheets

(58) Field of Classification Search
USPC ..... 343/890, 892
See application file for complete search history.

(56) References Cited

U.S. PATENT DOCUMENTS

| | | | | |
|---|---|---|---|---|
| 8,446,327 | B2 | 5/2013 | Vassilakis | |
| 2002/0089466 | A1* | 7/2002 | Magee | H01Q 1/1242 343/890 |
| 2004/0027307 | A1* | 2/2004 | Hossein | H01Q 1/1242 343/890 |
| 2005/0248496 | A1* | 11/2005 | Chen | H01Q 1/1228 343/766 |
| 2012/0218159 | A1* | 8/2012 | Ke | H01Q 1/246 343/760 |

FOREIGN PATENT DOCUMENTS

| | | | |
|---|---|---|---|
| JP | 2002-016424 | A | 1/2002 |
| WO | WO 2013/171291 | A2 | 11/2013 |

* cited by examiner

TWO-WAY ANTENNA MOUNTING BRACKET AND ASSEMBLY WITH INDEPENDENTLY ADJUSTABLE ELECTROMECHANICAL ANTENNA TILT AND AZIMUTHAL STEERING FOR BEAM RESHAPING

CROSS-REFERENCE TO RELATED PATENT APPLICATION(S)

This patent application claims priority to U.S. provisional application No. 62/103,599, filed on Jan. 15, 2015, the contents of which are incorporated in their entirety herein. In accordance with 37 C.F.R. § 1.76, a claim of priority is included in an Application Data Sheet filed concurrently herewith.

FIELD OF THE INVENTION

The present invention relates to systems and components of a mobile communications base station infrastructure. More particularly, the present invention is an apparatus, method, and system for providing remote azimuth steering and remote electromechanical tilting functions for any mobile communications base station antenna.

BACKGROUND OF THE INVENTION

In modern mobile communications networks, most importantly in 4th Generation (4G) Long Term Evolution (LTE) networks, antenna alignment is vital for delivery of fast and reliable mobile broadband connections, correct signal propagation, and spot-on network coverage throughout the entire mobile communications base station lifecycle. In current networks, frequent antenna alignment and antenna pattern changes are required not only to increase system capacity but also to allow for a smooth network operation in time-varying traffic conditions.

Antenna adaptation for optimal cell site coverage can be accomplished by reforming the antenna radiation pattern using any of three techniques: beam tilting, beam width forming or beam steering. In beam tilting, or electro-mechanical tilt, the front and back antenna lobes tilt in same direction, and the antenna horizontal radiation pattern is shaped so as to minimize the overlapping area along with the intra- and inter-cell interference. By physically displacing the antenna panel, either via mechanically tilting or rotating the antenna, changes occur along a single horizontal plane. Therefore, as the front lobe of the antenna is tilted down, the back lobe is, by default, tilted up. By changing the width of the beam, or azimuth beam width, the antenna's radiating elements are movable. This enables components such as compensating radio frequency feed line phase shifters to provide broad range of beam width angle variation of the antenna array's azimuth radiation pattern. In beam steering (changing the beam direction, or azimuth steering or pan, the antenna is mechanically rotated about a vertical axis to provide different geographic coverage.

To provide the aforementioned functionalities for adaptation of antenna coverage, phased-array antennas arrays with embedded systems providing radiated beam adjustment are typically employed in actual applications. Such antenna arrays typically comprise a reflector and a plurality of antenna elements coupled thereto for directing a beam of electromagnetic energy in a propagation direction. The antenna may include a plurality of phase shifters operatively connected to the antenna elements, and a control device operatively connected to the phase shifters to tilt the beam propagation direction. The antenna may further include an electromechanical system coupled to the antenna reflector for rotating the latter about a vertical axis to vary signal azimuth direction. The antenna may also include an electromechanical system coupled to the antenna array for adjusting relative radiator positioning to control beam width. Furthermore, such sophisticated antenna arrays are generally retrofitted with remote antenna adjustment systems enabling accurate network alterations to be carried via the Operational Maintenance Center (OMC) irrespective of weather conditions.

Antenna mechanical tilt adjustment methods practiced in the prior art typically entail the use of a set of conventional mechanical tilt brackets. Consequently, human intervention is required, making the adjustments dangerous, labor intensive and cost-inefficient. Furthermore, these methods demonstrate skewed antenna radiation footprint coverage when the antenna is offset with respect to the antenna boresight setting due to the fact that the mechanical tilt axis lies behind the azimuth steering axis. Additionally, prior art antenna mounting brackets featuring remote down-tilt methods cannot sustain high force loads due to mechanical design limitations. Moreover, they typically employ an electromechanical actuator comprising a coupled motor and a gear set without incorporating provisions for manually adjusting the mechanical tilt of the antenna beam in case of field service or component failure. Current methods of antenna remote azimuth steering (RAS) in the prior art also do not incorporate provisions for manually adjusting the azimuth of the antenna beam in case of field service or component failure.

Also, due to the importance of accurate antenna pointing to a reference azimuth and mechanical tilt direction, in order to minimize signal quality degradation, the use of complex alignment tools and geographic landmarks or electronic alignment devices to install the antenna bracket to the boresight setting is not recommended as they fail to provide the optimal antenna alignment due to a multitude of reasons such as multipath errors, soft and hard iron disturbances, lack of alignment with the antenna back etc. . Systems providing remote azimuth steering (RAS) functionalities that retain the antenna in the desired azimuth direction solely using a high-ratio gearbox, without incorporating any provisional means of reducing stress induced to the gearbox components by rapid load changed due to external forces, may experience mechanical looseness, eccentric shafts, gear wear, broken teeth, and bearing wear.

The prior art includes several antenna support structure solutions for providing remote electrical radiated beam steering. These structures typically comprise a stationary base, an adjustable antenna mounting bracket, and a variable electrical tilt phased-array. Such an antenna support structure may comprise a rotating base coupled to the adjustable antenna mounting bracket, a motor and a gear set operatively connected to the rotating base to adjust antenna azimuth direction. The antenna support structure may further comprise an adjustable lower and an upper tilt bracket coupled to the antenna mounting bracket, a motor and a gear set operatively connected to the tilt brackets to mechanically vary antenna tilt direction.

U.S. Pat. No. 8,446,327 B2 to Vassilakis discloses a two-way terrestrial antenna that includes electrical down-tilt and azimuth adjustment capabilities. The antenna system comprises an antenna support structure, an antenna including one or more radiating elements, and an antenna mounting structure coupling the antenna to the antenna support structure. The antenna mounting structure includes a movable mount allowing change of the antenna orientation. However, effecting a deviation from the support structure along the x-axis (down-tilt) and then adjusting the antenna azimuth, i.e. rotating around the antenna z-axis, orientates the antenna in a skewed position with both tilt and roll.

This antenna system also comprises an antenna position sensor module mounted on the antenna for detecting at least one of vertical and azimuth orientation with respect to the earth's magnetic field. However, digital compasses relying on the earth's magnetic field to provide heading are subject to hard and soft iron errors, acceleration errors, and severe inclinations that increase heading calculation complexity and measurement inaccuracy. Thus, to reduce measurement inaccuracy, supplementary measurements must be made and additional precautions may be required.

In addition, the antenna heading adjustment apparatus is fully motorized and no manual operation provisions have been made. As a result, an electrical failure may risk the system's operability. Furthermore, the system is conventionally mounted to a vertically-oriented supported structure using fixed bottom and top mounting brackets. Thus, it does not provide a remotely-controlled antenna mechanical tilt adjustment mechanism.

U.S. Pat. No. 7,183,996 B2 to Wensink teaches a method of making remote plumb-to-level and compass heading adjustments of multi-antenna sectors typically found in cellular telephone networks. A helix heading adjustment apparatus, or a Pitman arm arrangement, is used to provide antenna heading adjustment according to the readings collected from an electronic compass circuit board with respect to the earth's magnetic field. However, as explained in the previous paragraph, such antenna heading adjustment techniques are not optimal. Furthermore, the system provides antenna down-tilt using a hinged lower bracket and an upper tilt bracket connected to the antenna by links. The upper tilt bracket is mounted to a vertically-translating dust cover. Vertical motion of the dust cover is translated to tilting motion of the antenna by the links. However, the system does not provide mechanical up-tilt which is often employed in mobile network design and optimization in tandem with electrical tilt to reduce signal interference between neighboring sites by greatly suppressing antenna radiation pattern side lobes. In addition, the antenna tilt and heading adjustment apparatus is fully motorized and no manual operation provisions have been made. Thus, an electrical failure may risk the system's operability. Furthermore, the antenna tilt and heading adjustment apparatus includes a mechanical breaking arrangement employing an anti-rotate lock cap and lock teeth geometry. However, this breaking arrangement may not meet the increased load requirements of advanced ultra-wideband and multi-band mobile base station antenna arrays.

U.S. Patent Application No. 2005/0,248,496 A1 to Chen et al. discloses an adjustable antenna mount that can remotely control the direction of a mobile base station antenna. The antenna mount comprises a rotating base mounted on a stationary base. Both bases comprise a suitably-aligned gear set and a motor. The motor in the rotating base rotates the vertical gear set, a horizontal shaft, a set of rotation plates, the antenna bracket and the antenna in a vertical plane. Similarly, the motor in the stationary base rotates the horizontal gear set, a vertical shaft and the rotating base in the horizontal plane. Nevertheless, the antenna mount provides provisions only for relative azimuth alignment of the antenna panel. Thus, accurate azimuth alignment with respect to True or Grid North cannot be accomplished. Furthermore, no provisions for detecting and compensating for non-vertical orientation of the antenna mount are provided. Also, despite the fact that the antenna mount includes arrangements preventing the antenna from exceeding the maximum allowable vertical travel, no such arrangements exist for the horizontal plane. It is thus apparent that in case of position sensor failure, there are no precautionary measures restricting the maximum allowable horizontal travel. In addition, the antenna mount is fully motorized and no manual operation provisions have been made. Thus, as with other systems, an electrical failure may risk the system's operability.

WO 2013/171291 A2 to Kolokotronis discloses an antenna mounting assembly and method for installing and manually or remotely adjusting the direction of cellular antennas. The antenna mounting assembly comprises a reference frame, attached to an existing base station mast using a set of conventional mechanical tilt brackets, and an antenna mounting formation comprising an antenna and upper and lower antenna mount attached thereto, enabling antenna azimuth adjustment. However, as clarified above, the antenna's tilted azimuth rotation axis, that is parallel to the reference frame tilted axis, results in an inclined orbit with respect to the horizontal plane and in an adverse skewed antenna radiation pattern. The lower antenna mount includes either a motor or a manually driven azimuth steering unit. Thus, both modes of operation cannot be combined in a single unit resulting in system operability risk in case of an electrical failure. Furthermore, the antenna assembly is mounted to the antenna support via prior art hinged top and bottom tilt brackets. Thus, it does not provide a remotely-controlled antenna mechanical tilt adjustment mechanism. Furthermore, the lower antenna mount includes an antenna locking mechanism comprising a locking plate with a series of locking holes and a manually or linearly actuated locking pin. However, this breaking arrangement requires a big radius locking plate to provide azimuth offset resolution of fine increments.

Consequently there is a need not found in the prior art for an antenna mounting bracket for use in a communications network in which both antenna direction and inclination is remotely adjustable. There is also a need for remote operation that is capable of universal antenna mounting, precise antenna boresight orientation, azimuth steering, and mechanical tilt featuring both remote and manual operating modes. There is a further need for an efficient zero backlash gear system that is able to handle increased loads.

BRIEF SUMMARY OF THE INVENTION

Accordingly, it is one object of the present invention to provide an antenna assembly that enables delivery of fast and reliable mobile broadband connections, correct signal propagation, and accurate network coverage throughout an entire lifecycle of a mobile communications base station. It is another object of the present invention to provide an antenna assembly that enables antenna alignment and pattern changes to increase system capacity and allow for smooth network operation in time-varying traffic conditions. It is a further object of the present invention to provide a system and method of antenna mounting in which both antenna direction and inclination are remotely adjustable.

It is another object of the present invention to provide a high-load electromechanical remote mechanical tilt arrangement, ensuring both up and down tilt antenna adjustment with absolute reference to the local horizontal plane without requiring working above ground, while allowing both remote mechanical tilt adjustment and manual mechanical tilt operation. It is still another object of the present invention to provide an electromechanical remote azimuth steering arrangement with an integrated motor and gearing assembly, allowing both remote azimuth steering and manual operation without losing the calibration between the motor and the antenna azimuth setting once user intervention is required.

Another object of the present invention is to provide an electromechanical remote azimuth steering arrangement with an integrated antenna orientation sensor to accurately align the antenna bracket to the boresight setting, measuring all orientation parameters including antenna azimuth with respect to True or Grid North, tilt and roll with respect to the horizontal plane, as well as antenna latitude, longitude and altitude. An additional object of the present invention is to provide an electromechanical remote azimuth steering arrangement with an integrated highly efficient backlash-free gear system providing antenna rotation slow-down and position sustain.

The present invention is an antenna mounting bracket and assembly that provides industry with a cost-effective means of upgrading any mobile communications base station antenna to a two, three or four way antenna. The antenna mounting bracket and assembly introduces both Remote Azimuth Steering (RAS) and Remote Mechanical Tilt (RMT) functionalities to communications networks to address the aforementioned issues with prior art antenna configurations.

The present invention provides an assembly for supporting an antenna array in a mobile communications network. The assembly includes a bracket mechanism onto which an antenna array is mounted, and a two-way beam azimuth and inclinational positioning system coupled to the bracket mechanism. The two-way system includes an azimuthal steering arrangement configured to provide angular adjustment of the antenna beam azimuth. The two-way system also includes an electromechanical tilting arrangement configured to adjust the antenna tilt position. As shown in FIG. 1, the two-way system is operable in different modes to independently and variably adjust azimuthal angle and tilt position for both remote and manual control of signal propagation and network coverage accuracy. Furthermore, the present invention comprises a plurality of electronic circuitry components and boards to control the various functions of the two-way antenna mounting bracket assembly, including an Antenna Interface Standards Group (AISG) compatible RAS board and a RMT board.

In one embodiment of the present invention, an assembly for a mobile communications system comprises an antenna array including one or more radiating elements; a stationary backbone pole; an antenna azimuth steering arrangement comprising a rotating pole, a plurality of bracket arms coupling the antenna array to the rotating pole, a steering drive unit linked to the rotating pole by a coupler at a lower end of the rotating pole, the steering drive unit configured to control movement of the rotating pole about the rotational portion of each linkage arm and, so as to electromechanically adjust an azimuthal angle of the antenna array relative to a reference axis and to prevent unintended movement of the rotating pole; a mounting brace coupling the antenna azimuth steering arrangement to the stationary backbone pole; an antenna tilting arrangement comprising a first telescopic mechanical tilt system attached to an upper end of the antenna array and to the rotating pole proximate to the rotational portion of a linkage arm at an upper end of the rotating pole by a first mounting clamp, a second telescopic mechanical tilt system attached to a lower end of the antenna array and to the rotating pole proximate to the rotational portion of a linkage arm at a lower end of the rotating pole by a second mounting clamp, the first and second telescopic mechanical tilt systems configured to adjust a tilt angle of the antenna array relative to the upper end of the rotating pole and to the lower end of the rotating pole, so as to electromechanically adjust the tilt angle of the antenna array relative to a reference plane and to prevent unintended movement of the antenna array; and an antenna orientation sensor that enables accurate alignment of the antenna array by measuring orientation parameters, and tilt and roll with respect to a horizontal plane.

In another embodiment, the present invention includes an apparatus comprising a mobile network communications array including a plurality of antenna elements for directing a beam of electromagnetic energy in a desired propagation direction and at a desired inclination; and a bracket assembly for supporting and positioning the plurality of antenna elements to independently and variably achieve the desired propagation direction and the desired inclination, the bracket assembly including at least one of an antenna tilt system configured to electromechanically or manually adjust both an upper end bracket arm and a lower end bracket arm of the mobile network communications array relative to a reference plane to shape an antenna radiation pattern, and an azimuth angle steering system configured to electromechanically or manually adjust an azimuth angle of the mobile network communications array by rotating the rotating pole relative to a reference axis to shape the antenna radiation pattern, the azimuth angle steering system including a steering drive unit having an integrated motor and gearing assembly that allows both remote azimuth steering and manual operation without a calibration loss between a motor and an antenna azimuth setting once user intervention is required.

In still another embodiment, the present invention includes a method of adjusting an inclination and direction of an antenna array in a mobile communications network, comprising adjusting a tilt angle of an antenna array at both an upper end bracket arm and a lower end bracket arm of an assembly coupling the antenna array to a support structure, and relative to a reference plane, to shape an antenna radiation pattern and direct a beam of electromagnetic energy at a desired inclination by horizontal, vertical and pivotal displacement of the assembly; adjusting an azimuth angle of the antenna array by rotating a rotating pole relative to a reference axis, to shape the antenna radiation pattern and direct a beam of electromagnetic energy in a desired propagation direction; and steering a tilting movement of the antenna array relative to the reference plane by a tilting drive unit, and a rotational movement of the rotating pole by an azimuth steering drive unit, to independently and variably achieve the desired propagation direction and the desired inclination.

Other objects, embodiments, features and advantages of the present invention will become apparent from the following description of the embodiments, taken together with the accompanying drawings, which illustrate, by way of example, the principles of the invention.

BRIEF DESCRIPTION OF THE SEVERAL VIEWS OF THE DRAWINGS

The accompanying drawings, which are incorporated in and constitute a part of this specification, illustrate several embodiments of the invention and together with the description, serve to explain the principles of the invention.

DETAILED DESCRIPTION OF THE INVENTION

In the following description of the present invention reference is made to the exemplary embodiments illustrating the principles of the present invention and how it is practiced. Other embodiments will be utilized to practice the present invention and structural and functional changes will be made thereto without departing from the scope of the present invention. The accompanying drawings, which are incorporated in and constitute a part of this specification, illustrate several embodiments of the invention and together with the description, serve to explain the principles of the invention.

Figure 1:
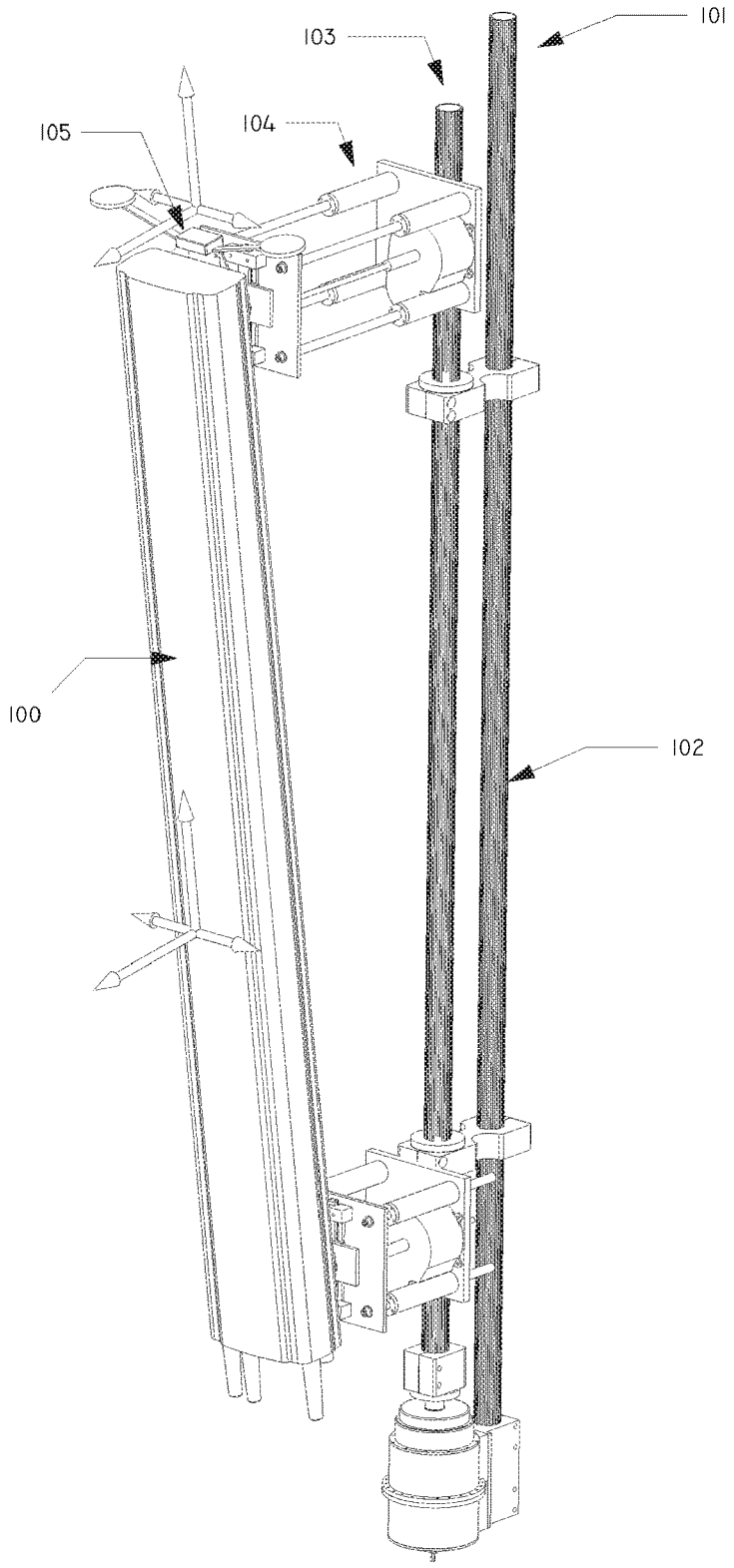
FIG. 1 is a perspective view of a two-way antenna mounting bracket and assembly according to the present invention.

FIG. 1 illustrates a perspective view of an antenna array 100 mounted on a two-way antenna mounting bracket assembly 101 according to an exemplary implementation of the present invention. The two-way antenna mounting bracket assembly 101 comprises a stationary backbone pole 102 that is attached to a mounting support structure using bottom and top mounting brackets, an electromechanical remote azimuth steering arrangement 103, an electromechanical remote mechanical tilt arrangement 104 coupled to the antenna array 100.

Azimuthal Steering Function

Figure 2:
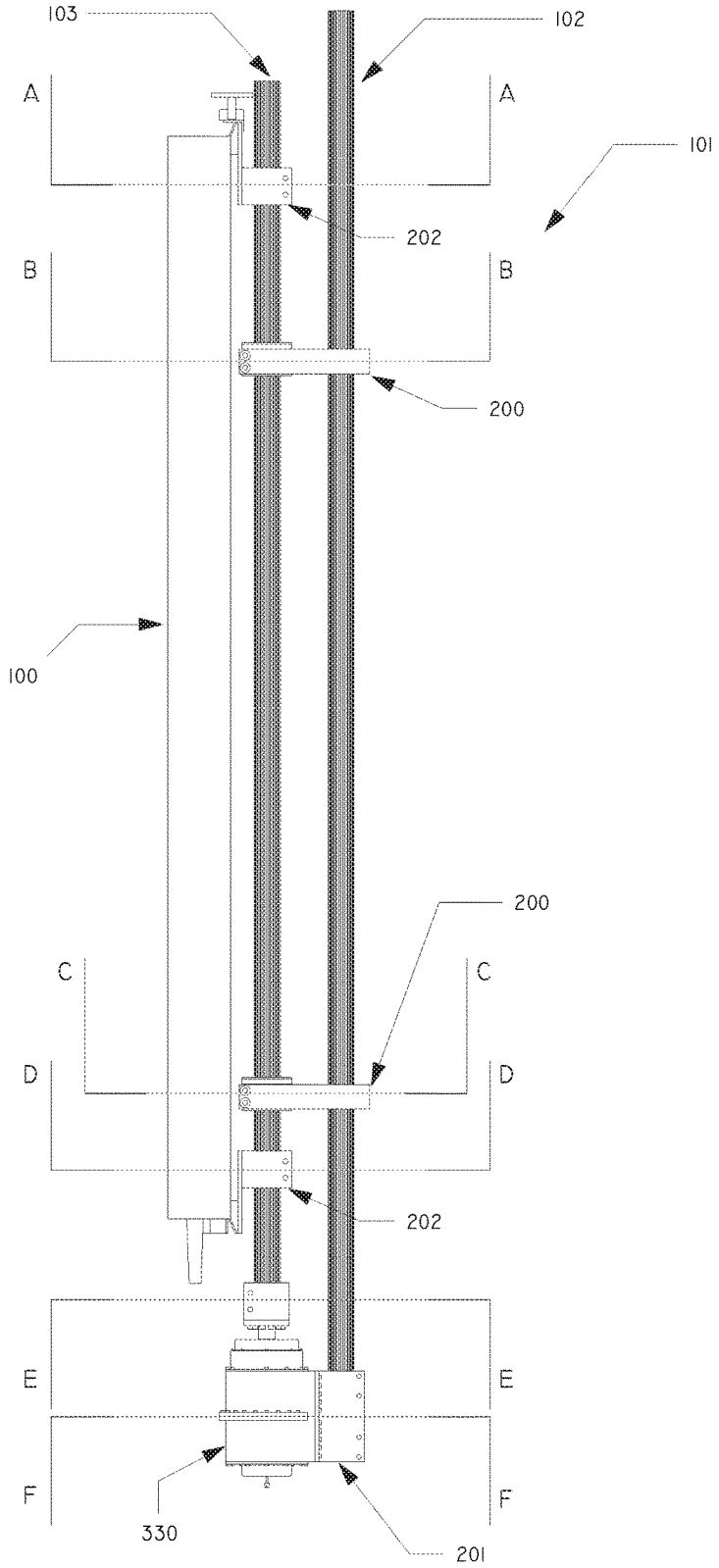
FIG. 2 is a side view of an antenna array mounted on the two-way antenna mounting bracket and assembly having only remote azimuth steering.
Figure 3A:
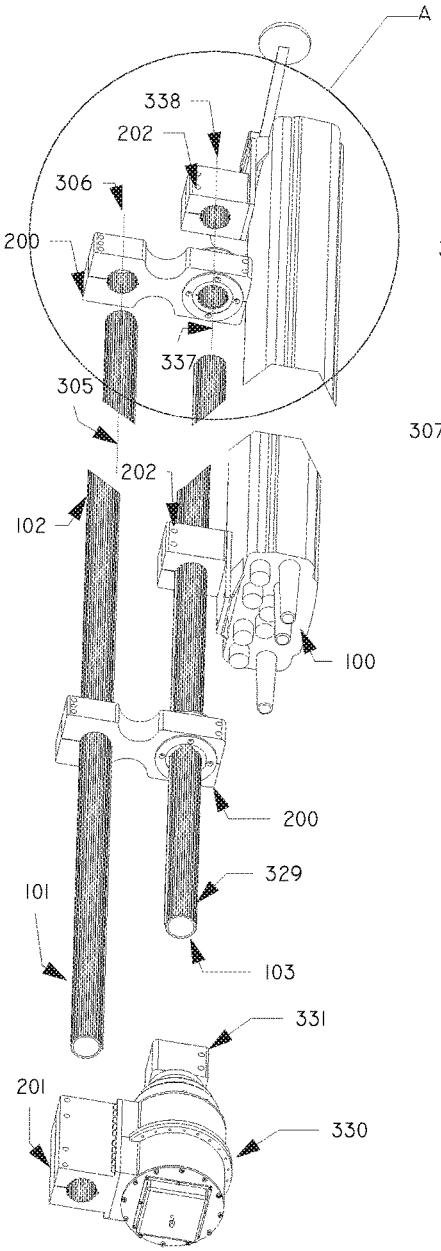
FIG. 3A is an exploded, close-up view of an electromechanical remote azimuth steering arrangement according to the embodiment of FIG. 2.

FIG. 2 shows a side view of the two-way antenna mounting bracket assembly 101 according to one embodiment of the present invention, which includes a first mode of operation that enables angular adjustment of the antenna beam azimuth for directional signal propagation. In this embodiment, the two-way antenna mounting bracket assembly 101 may include the electromechanical remote azimuth steering arrangement 103 that is attached to the backbone pole 102 using a first linkage arm and a second linkage arm 200, and a mounting brace 201 fitted over the outer diameter of the stationary backbone pole 102, as shown in FIG. 3A. It will be appreciated by those skilled in the art that the same reference designator 200 may be used to refer to both the first linkage arm and second linkage arm interchangeably.

Figure 3B:
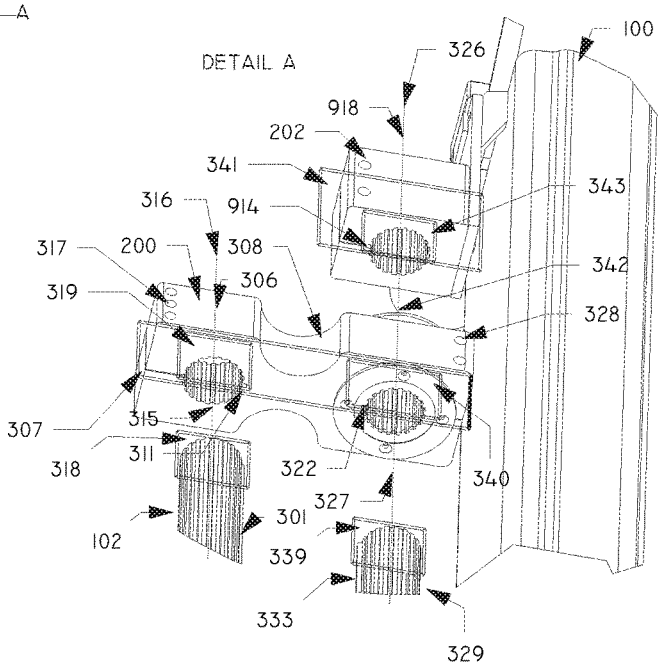
FIG. 3B is a further exploded, close-up view of an electromechanical remote azimuth steering arrangement showing detail area "A" of FIG. 3A.
Figure 3C:
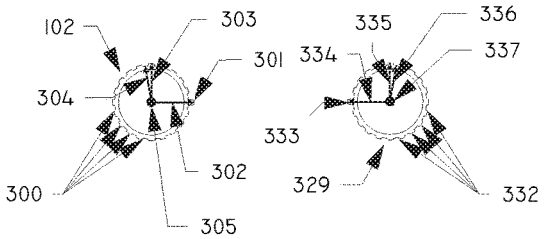
FIG. 3C is a cross-sectional view of a stationary backbone pole and a cross-sectional view of a rotating pole of the electromechanical remote azimuth steering arrangement according to the present invention.

With reference to FIG. 3A and FIG. 3B the stationary backbone pole 102 includes an elongated tube having a length, an inner surface and an outer surface. Details pertaining to the stationary backbone pole 102 are shown in FIG. 3C. The outer surface of the elongated tube includes a spline twist prevention formation 300, for firmly interlocking the backbone pole 102 to the first linkage arm and the second linkage arm 200, and an alignment formation 301 for aligning the relative position of the backbone pole 102 with respect to the first linkage arm and the second linkage arm.

FIG. 3C presents a cross-sectional view of the stationary backbone pole 102 according to one aspect of the present invention. The spline twist prevention formation 300 includes a plurality of regularly spaced protrusions, preferably rectangular shaped, extending along the entire length of the elongated tube. The alignment formation 301 has a protrusion, which may be rectangular in shape, and having different dimensions than the twist prevention formation protrusions, extending along the length of the elongated tube. The outer surface of the elongated tube has a first cross-sectional radius 302 at the alignment formation 301 protrusion, a second cross-sectional radius 303 at the twist prevention formation protrusions and a third cross-sectional radius 304 at an angle from the second cross-sectional radius. The first cross-sectional radius is larger than the second cross-sectional radius by the difference in height of the alignment formation protrusion and the twist prevention formation protrusions. The second cross-sectional radius is larger than the third cross-sectional radius by the height of the twist prevention formation protrusions. Three concentric cross-sectional circular planes may be defined using the aforementioned cross-sectional radiuses. The cross-sectional circular planes may have a common central axis 305 that is collinear with the backbone pole central axis 306, as shown in FIG. 3A. The inner surface of the elongated tube has a circular profile.

Details pertaining to the first linkage arm and the second linkage arms 200 are shown in FIG. 3B. The first linkage arm and the second linkage arm 200 have an upper wall, a lower wall, a front wall, a rear wall and two sidewalls. The first linkage arm and the second linkage arm 200 are generally symmetrical about a longitudinal (vertical) bisectional plane 307. The upper wall, the lower wall, the front wall and the rear wall may preferably be flat and the sidewalls may be formed differently, incorporating a curved section 308. Said curved section may be designed in such a way as to ensure that, when the electromechanical remote azimuth steering arrangement 103 is moved, uncontrolled oscillations of its center of gravity do not affect its stability or exert excessive strain on its structure.

Figure 3D:
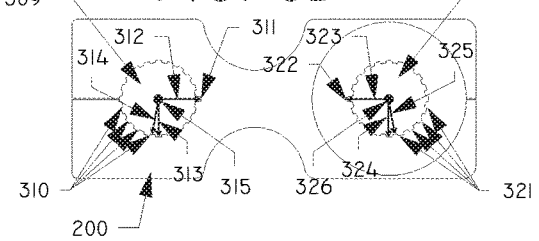
FIG. 3D is a cross-sectional view of a linkage arm coupling a backbone pole with a rotating pole of the electromechanical remote azimuth steering arrangement according to one embodiment of the present invention.

FIG. 3D shows a cross-sectional view of the first linkage arm and the second linkage arm 200. An elongated backbone pole fitting cavity 309 may be formed from the first linkage arm upper wall to the opposite first linkage arm lower wall and from the second linkage arm upper wall to the opposite second linkage arm lower wall. The shape of the backbone pole fitting cavity 309 may preferably be tubular with splines having a central axis at a predefined offset from the rear wall and sidewalls.

With further reference to FIG. 3D, the elongated backbone pole fitting cavity 309 includes a spline twist prevention formation 310, for firmly interlocking the backbone pole 102 to the first linkage arm and the second linkage arm 200, and an alignment formation 311, for aligning the relative position of the backbone pole 102 with respect to the first linkage arm and the second linkage arm 200. The spline twist prevention formation includes a plurality of regularly spaced recesses, which may have a rectangular shape, extending along the entire length of the elongated cavity 309. The alignment formation includes a recess, which may also have rectangular shape, and which may have different dimensions than the twist prevention formation recesses, extending along the length of the elongated cavity 309. The elongated backbone pole fitting cavity 309 has a first cross sectional radius 312 at the alignment formation recess, a second cross-sectional radius 313 at the twist prevention formation recesses and a third-cross sectional radius 314 at an angle from the second cross-sectional radius. The first-cross sectional radius 312 is larger than the second cross-sectional radius 313 by the difference in height of the alignment formation recess and the twist prevention formation recesses. The second cross-sectional radius 313 is larger than the third cross-sectional radius 314 by the height of the twist prevention formation recesses. Three concentric cross-sectional circular planes may be defined using the aforementioned cross-sectional radiuses. The cross-sectional circular planes may have a common central axis 315 that is collinear with the elongated backbone pole fitting cavity central axis 316, lying on the longitudinal (vertical) bisectional plane 307, as shown in FIG. 3B.

As shown in FIG. 3B, the first linkage arm and the second linkage arm 200 may also include a first locking mechanism 317. The locking mechanism 317 may be operable to fixedly attach the first linkage arm and the second linkage arm 200 at a particular position along the stationary backbone pole 102, once they are slideably coupled to the latter. The locking mechanism 317 may be of several varieties, such as a set of screws or a lever. The locking mechanism 317 may be engaged to push the first linkage arm backbone pole fitting cavity inner surface area and the second linkage arm backbone pole fitting cavity inner surface area against the backbone pole outer surface area to create additional tightness. It is to be understood that other securing and locking mechanisms may be incorporated and are within the scope of the present invention, and that therefore this description is not to be limited to any one mechanism discussed herein.

As shown in FIG. 3B, the first linkage arm and the second linkage arm 200 may be slideably engaged to the stationary backbone pole 102 in a unique orientation by means of an alignment formation comprising an index recess 311 and a mating index protrusion 301. It is to be understood that other engagement and alignment means may be incorporated and are within the scope of the present invention, and that therefore this description is not to be limited to any one engagement or alignment means discussed herein.

Figure 4A:
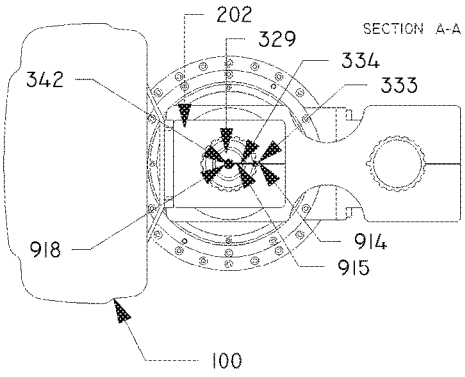
FIG. 4A is a cross-sectional view of the two-way antenna mounting bracket assembly of the present invention taken along lines A-A of FIG. 2
Figure 4D:
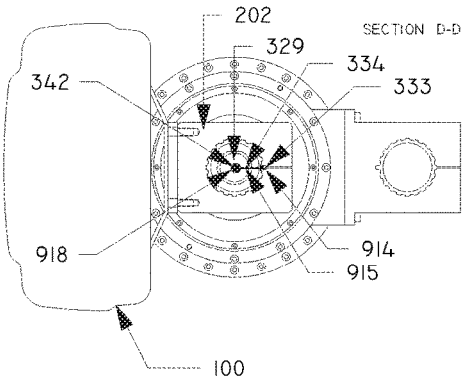
FIG. 4D is a cross-sectional view of the two-way antenna mounting bracket assembly of the present invention taken along lines D-D of FIG. 2.
Figure 4B:
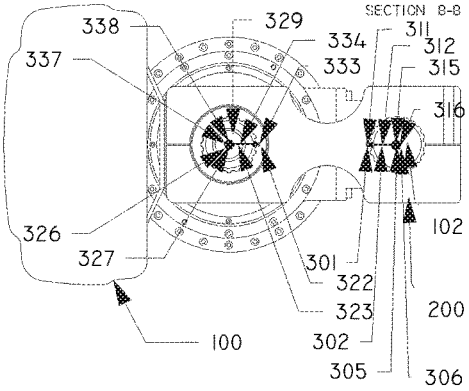
FIG. 4B is a cross-sectional view of the two-way antenna mounting bracket assembly of the present invention, taken along lines B-B of FIG. 2.
Figure 4C:
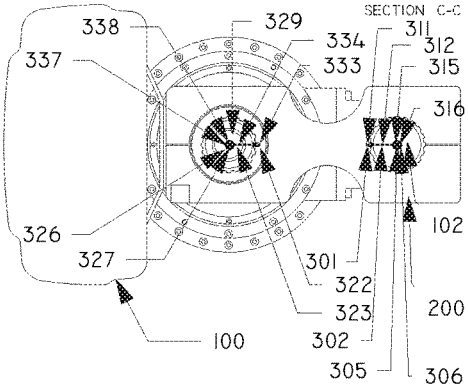
FIG. 4C is a cross-sectional view of the two-way antenna mounting bracket assembly of the present invention, taken along lines C-C of FIG. 2.

FIG. 4B and FIG. 4C illustrate two cross-sectional views of the two-way antenna mounting bracket assembly 101 taken along lines B-B and C-C of FIG. 2. As shown in FIG. 4B, an assembly comprising a first linkage arm 200 and a stationary backbone pole 102 may be slideably engaged and positioned in a first reference position. In the same manner, as shown in FIG. 4C, an assembly comprising a second linkage arm 200 and the stationary backbone pole 102 may be slideably engaged and positioned in the first reference position. With further reference to FIG. 4B and FIG. 4C, in the said first reference position, the backbone pole first cross sectional radius 302 axis at the alignment formation 301 protrusion is collinear with the first linkage arm and second linkage arm backbone pole fitting cavity first cross sectional radius 312 axis at the alignment formation 311 recess and perpendicular to the back wall of the antenna array 100. Furthermore, in the said first reference position, the backbone pole fitting cavity cross sectional central axis 315 is collinear with the elongated backbone pole fitting cavity central axis 316, the backbone pole cross sectional central axis 305 and the backbone pole central axis 306, lying on the longitudinal (vertical) bisection plane (not shown). Similarly, in the said first reference position, as shown in FIG. 3B, the points lying on backbone pole first cross sectional radius axis vertical plane 318 at the alignment formation 301 protrusion and the first linkage arm and second linkage arm backbone pole fitting cavity first cross sectional radius axis vertical plane 319 at the alignment formation recess define a first reference position plane. The said first reference position plane and the first linkage arm and second linkage arm longitudinal (vertical) bisection plane 307 are coincident and perpendicular to the back wall of the antenna array 100.

It should be noted that the descriptive terms top and bottom, upper and lower, and front and back and the like are used to aid in the description of the embodiments as shown in the drawings and are not intended to limit the embodiment or any of its parts orientation in space.

Continuing to refer to FIG. 3B, an electromechanical remote azimuth steering arrangement fitting cavity (not shown) may be formed from the first linkage arm upper wall to the opposite first linkage arm lower wall and from the second linkage arm upper wall to the opposite second linkage arm lower wall. The shape of the electromechanical remote azimuth steering arrangement fitting cavity may preferably be tubular having a central axis at a predefined offset from the rear wall and sidewalls.

A low-friction bushing or a bearing (not shown) may be integrated in the first linkage arm and second linkage arm electromechanical remote azimuth steering arrangement fitting cavity to reduce rotational friction and support radial and axial loads. Preferably a self-lubricating bushing may be integrated in the electromechanical remote azimuth steering arrangement fitting cavity to withstand high temperatures and have high load-bearing tolerances.

With reference to FIG. 3D, an insert 320 snaps over the inner diameter of the self-lubricating bushing allowing for interlocking and aligning the electromechanical remote azimuth steering arrangement 103 with the upper linkage arm and the lower linkage arm 200. The insert inner surface may include a spline twist prevention formation 321, for firmly interlocking the electromechanical remote azimuth steering arrangement 103 to the first linkage arm and the second linkage arm 200, and an alignment formation 322, for aligning the relative position of the electromechanical remote azimuth steering arrangement 103 with respect to the first linkage arm and the second linkage arm 200. The spline twist prevention formation includes a plurality of regularly spaced recesses, preferably rectangular shaped, extending along the entire length of the elongated insert. The alignment formation comprises a recess, preferably rectangular shaped having different dimensions than the twist prevention formation recesses, extending along the length of the elongated insert. The insert has a first cross-sectional radius 323 at the alignment formation recess, a second cross-sectional radius 324 at the twist prevention formation recesses and a third cross-sectional radius 325 at an angle from the second cross-sectional radius 324. The first cross-sectional radius 323 is larger than the second cross-sectional radius 324 by the difference in height of the alignment formation recess and the twist prevention formation recesses. The second-cross sectional radius 324 is larger than the third cross-sectional radius 325 by the height of the twist prevention formation recesses. Three concentric cross-sectional circular planes may be defined using the aforementioned cross-sectional radiuses. The cross-sectional circular planes may have a common central axis 326 that is collinear with the insert central axis 327, lying on the longitudinal (vertical) bisection plane 307, as shown in FIG. 3B.

As shown in FIG. 3B, the first linkage arm and the second linkage arm 200 may include a second locking mechanism 328. This locking mechanism 328 may be operable to fixedly attach the first linkage arm and the second linkage arm 200 at a particular position along the electromechanical remote azimuth steering arrangement 103, once they are slideably coupled to the latter. The locking mechanism 328 may be of several varieties, such as a set of screws or a lever. The mechanism 328 may be engaged in a manner whereby the locking mechanism 328 is tightened, pushing the first linkage arm electromechanical remote azimuth steering fitting cavity inner surface area and the second linkage arm electromechanical remote azimuth steering fitting cavity inner surface area against the electromechanical remote azimuth steering rotating pole outer surface area to create additional tightness. As noted above, it is to be understood that other securing and locking mechanisms may be incorporated, and are within the scope of, the present invention, and therefore this description is not to be limited to any one mechanism discussed herein.

Referring back to FIG. 3A, the electromechanical remote azimuth steering arrangement 103 may further include a rotating pole 329 and a remote azimuth steering unit 330, attached to the backbone pole 102 using a mounting brace 201 and operatively coupled to the rotating pole 329 using a coupler 331.

With reference to FIG. 3A and FIG. 3B the rotating pole 329 is comprised of an elongated tube having a length, an inner surface and an outer surface. Details of pertaining to the rotating pole 329 are shown in FIG. 3C The outer surface of the elongated tube includes a spline twist prevention formation 332, for firmly interlocking the rotating pole 329 to the first linkage arm and the second linkage arm 200, and an alignment formation 333, for aligning the relative position of the rotating pole 329 with respect to the first linkage arm and the second linkage arm 200.

FIG. 3C presents a cross-sectional view of the rotating pole 329 according to an exemplary implementation of the present invention. The spline twist prevention formation 332 has a plurality of regularly spaced protrusions, preferably rectangular shaped, extending along the entire length of the elongated tube. The alignment formation 333 has a protrusion, preferably rectangular shaped having different dimensions than the twist prevention formation protrusions, extending along the length of the elongated tube. The outer surface of the elongated tube has a first cross-sectional radius 334 at the alignment formation protrusion, a second cross-sectional radius 335 at the twist prevention formation protrusions and a third cross-sectional radius 336 at an angle from the second cross-sectional radius 335. The first cross-sectional radius 334 is larger than the second cross-sectional radius 335 by the difference in height of the alignment formation protrusion and the twist prevention formation protrusions. The second cross-sectional radius 335 is larger than the third cross-sectional radius 336 by the height of the twist prevention formation protrusions. Three concentric cross-sectional circular planes may be defined using the aforementioned cross-sectional radiuses. The cross-sectional circular planes may have a common central axis 337 that is collinear with the rotating pole central axis 338, as shown in FIG. 3A. The inner surface of the elongated tube has a circular profile.

As shown in FIG. 3B, the first linkage arm and the second linkage arm 200 may be slideably engaged to the rotating pole 329 in a unique orientation by means of an alignment formation comprising an index recess 322 and a mating index protrusion 333. It is to be understood that other engagement and alignment means may be incorporated and are within the scope of the present invention, and that therefore this description is not to be limited to any one engagement or alignment means discussed herein.

FIG. 4B and FIG. 4C illustrate two cross-sectional views of the two-way antenna mounting bracket assembly 101 taken along lines B-B and C-C of FIG. 2. As shown in FIG. 4B, an assembly comprising a first linkage arm 200 and a rotating pole 329 may be slideably engaged and positioned in a second reference position. In the same manner, as shown in FIG. 4C, an assembly comprising a second linkage arm 200 and the said rotating pole 329 may be slideably engaged and positioned in the said second reference position. With further reference to FIG. 4B and FIG. 4C, in the said second reference position, the rotating pole first cross-sectional radius 334 axis at the alignment formation 333 protrusion is collinear with the first linkage arm and second linkage arm insert first cross sectional radius 323 axis at the alignment formation 322 recess and perpendicular to the back wall of the antenna array 100. Furthermore, in the said second reference position, the electromechanical remote azimuth steering arrangement fitting cavity insert cross sectional central axis 326 is collinear with the electromechanical remote azimuth steering arrangement fitting cavity insert central axis 327, the rotating pole cross sectional central axis 337 and the rotating pole central axis 338, lying on the longitudinal (vertical) bisectional plane (not shown). Similarly, in the said second reference position, as shown in FIG. 3B, the points lying on the rotating pole first cross sectional radius axis vertical plane 339 at the alignment formation 333 protrusion and the first linkage arm and second linkage arm insert first cross-sectional radius axis vertical plane 340 at the alignment formation recess define a second reference position plane. The said second reference position plane and the first linkage arm and second linkage arm longitudinal (vertical) bisectional plane are coincident and perpendicular to the back wall of the antenna array 100.

It should be noted that the descriptive terms top and bottom, upper and lower, and front and back and the like are used to aid in the description of the embodiments as shown in the drawings and are not intended to limit the embodiment or any of its parts orientation in space.

In this manner, the first linkage arm and the second linkage arm 200 may be slideably engaged to both the stationary backbone pole 102 and the electromechanical remote azimuth steering arrangement 103 rotating pole 329, in a unique orientation defined by the first linkage arm and second linkage arm longitudinal (vertical) bisectional plane 307 which is coincident with the first reference position plane and the second reference position plane and perpendicular to the back wall of the antenna array 100.

As shown in FIG. 2, in one embodiment of the present invention the electromechanical remote azimuth steering arrangement 103 may further incorporate a remote azimuth steering unit 330 to enable remote antenna array azimuth beam angle adjustment. The remote azimuth steering unit 330 is positioned at the bottom of the remote azimuth steering arrangement 103 for ease of field servicing in case of malfunction.

Figure 5A:
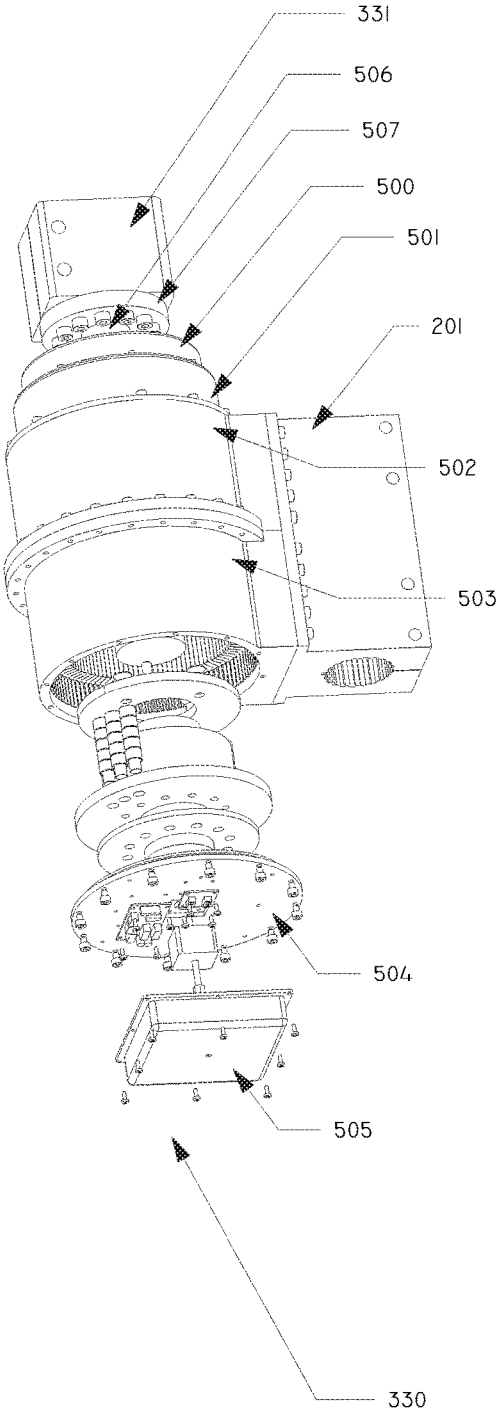
FIG. 5A is an exploded perspective view of the remote azimuth steering unit components according to one embodiment of the present invention.
Figure 5B:
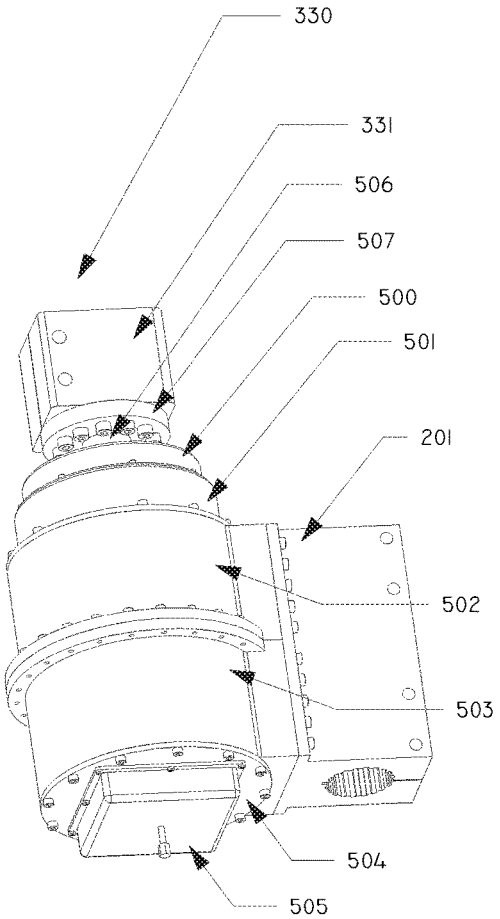
FIG. 5B is another exploded perspective view of the remote azimuth steering unit components according to one embodiment of the present invention.

FIG. 5A shows a perspective view of a partly disassembled remote azimuth steering unit 330 engaged to the coupler 331 and the mounting brace 201 according to this embodiment. FIG. 5B shows a perspective view of an assembled remote azimuth steering unit 330 engaged to the coupler 331 and the mounting brace 201. As shown in FIG. 5A and FIG. 5B, the remote azimuth steering unit 330 may generally comprise an upper top housing 500 and a lower top housing 501, an upper middle housing 502 and a lower middle housing 503, a bottom cover 504, a bottom housing 505 and a rotatable output shaft 506 that is coupled using a mounting flange 507 to the rotating pole coupler 331.

Figure 6:
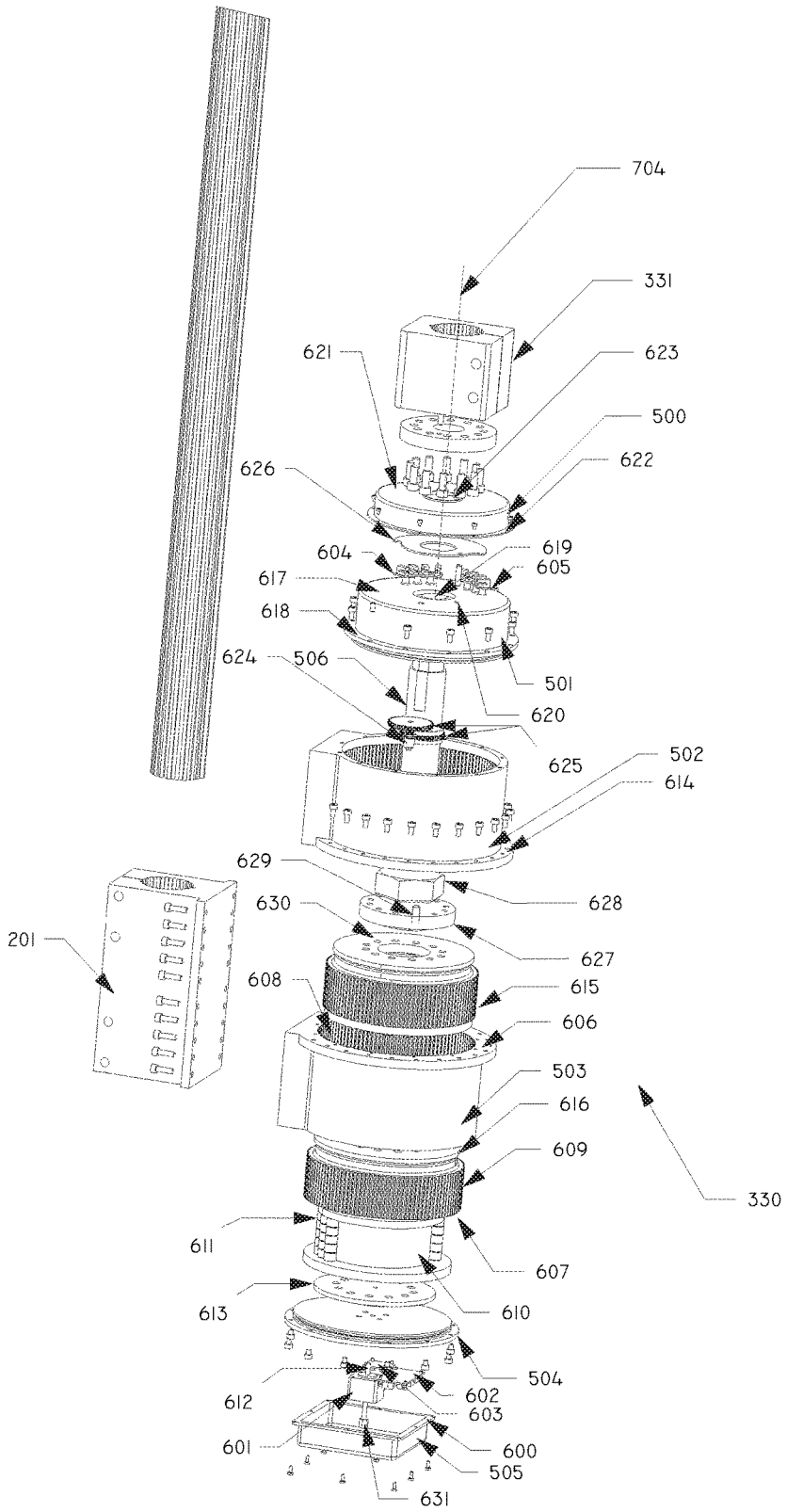
FIG. 6 is another exploded view of the remote azimuth steering unit components according to one aspect of the present invention.

FIG. 6 shows a perspective view of a fully disassembled remote azimuth steering unit 330 disengaged from the coupler 331 and the mounting brace 201. The bottom housing 505 may generally be cuboid shaped having a top rim 600 providing a plurality of mounting holes used for mounting the bottom housing 505 on the bottom cover 504. The bottom housing 505 may include an actuator 601, a remote azimuth steering (RAS) board 602 and an azimuth offset configuration board 603. The actuator, the remote azimuth steering (RAS) board 602 and the azimuth offset configuration board 603 allow remote control over the direction of signal propagation, or azimuth, of the antenna array 100.

Typically, the actuator 601 may be any type of electromechanical device which converts electrical energy into mechanical movement. Preferably, the actuator 601 is a high speed, low torque dual shaft stepper motor to minimize the required electrical power consumption and to maintain manual control over antenna array azimuth if such need may arise in case of malfunction or electrical power failure.

The remote azimuth steering (RAS) board 602 comprises a microprocessor and a plurality of integrated circuits that control the remote azimuth steering arrangement subsystems, such as the position sensing subsystem, the stepper motor driving subsystem and the Antenna Interface Standards Group (AISG) communication interface. Male and female AISG connectors facilitate daisy-chained device connection on a single RS bus. This is discussed further herein with reference to FIG. 12.

The azimuth offset configuration board 603 provides configuration of the antenna array's allowable clockwise and counterclockwise rotational motion range. The azimuth offset configuration board comprises a plurality of toggle switches, preferably dual inline package switches (DIP switches) 1208, connected to the minimum azimuth offset optical limit switches 604 and the maximum azimuth offset optical limit switches 605. Thus, by setting a toggle switch to the appropriate position, the corresponding minimum and maximum azimuth offset optical limit switch 604 and 605 may be enabled or disabled. This is particularly desirable when uneven antenna array allowable clockwise and counterclockwise rotatable motion range constraints must be satisfied.

Returning again to FIG. 6, the lower middle housing 503 may generally be tubular shaped having a top rim 606 providing a plurality of mounting holes used for attaching the lower middle housing 503 to the upper middle housing 502. The lower middle housing 503 may include a first stage speed reduction arrangement 607. The first stage speed reduction arrangement 607 may preferably be a strain wave gearing mechanism.

The first stage speed reduction arrangement 607 may be comprised of a toothed mechanism composed of a rigid circular spline 608, a flexible elliptical spline 609 and an elliptical strain wave generator 610.

The rigid circular spline 608 is a fixed round rigid ring with teeth on the internal spline. Preferably, the rigid circular spline is formed on the lower middle housing 503 inner surface.

The flexible elliptical spline 609 is a non-rigid thin walled cylindrical cup with external teeth and slightly smaller diameter than the circular spline. The flexible elliptical spline 609 may preferably incorporate two less teeth than the rigid circular spline on its outer circumference.

The strain wave generator 610 may comprise an elliptical ball-bearing assembly 611 rotating within the flexible spline 609 and deflecting it from its natural circular form into an elliptoidal shape; thus, more than two teeth of the flexible spline 609 may mesh with the circular spline 608 at two diametrically opposite regions on the major axis of the elliptoid. In another embodiment of the present invention, at least seven teeth of the flexible spline may mesh with the circular spline at two diametrically opposite regions on the major axis of the elliptoid.

The actuator output shaft 612 is operatively connected to the first stage speed reduction arrangement 607 using a suitable high rigidity coupling plate 613 to enable actuator output shaft rotational motion to be transferred to the first stage speed reduction arrangement 607 to act as a braking mechanism for inclinational movement of the antenna array 100.

Continuing to refer to FIG. 6, the upper middle housing 502 may generally be tubular shaped having a bottom rim 614 providing a plurality of mounting holes used for attaching the upper middle housing 502 to the lower middle housing 503. The upper middle housing 502 may include a second stage speed reduction arrangement 615. The second stage speed reduction arrangement 615 may be similar to the first stage speed reduction arrangement 607. The second stage speed reduction arrangement 615 may likewise comprise a rigid circular spline, a flexible elliptical spline and an elliptical strain wave generator. The second stage speed reduction arrangement 615 is directly coupled to the first stage speed reduction arrangement 607 using a suitable high rigidity coupling plate 616 to enable first stage speed reduction arrangement rotational motion to be transferred to the second stage speed reduction arrangement 615 to act as braking mechanism for rotational motion of the antenna array 100.

The lower top housing 501 may generally be tubular shaped having a top surface 617 and a bottom rim 618. The bottom rim 618 provides a plurality of mounting holes used for attaching the lower top housing 501 to the upper middle housing 502. The top surface 617 provides overall rigidity and may further include an output shaft fitting cavity 618. The lower top housing 501 may further incorporate an alignment bore 620 to provide angular reference for aligning other remote azimuth steering unit rotating components with respect to the said alignment bore 620.

The upper top housing 500 may generally be tubular shaped having a top surface 621 and a bottom rim 622. The bottom rim 622 provides a plurality of mounting holes used for attaching the upper top housing 500 to the lower top housing 501. The top surface 621 provides overall rigidity and may further include an output shaft fitting cavity 623 which is concentric with the lower top housing output shaft fitting cavity 619.

The upper top housing 500 may include a high resolution single turn absolute encoder 624 that is coupled to the output shaft 506 using a gear assembly 625 having a one-to-one gear ratio to report absolute output shaft positional information with respect to a reference position. The high resolution single turn absolute encoder 624 has a unique digital output for each output shaft position and provides true, or absolute, position regardless of power interruptions. Thus, upon a loss of power, the high resolution single turn absolute encoder 624 will provide the correct absolute position when power is restored.

The upper top housing 500 may further include an output shaft disc 626 that is coupled to the output shaft 506 to limit the extent of the allowable clockwise and counterclockwise rotational motion range of the antenna array 100.

Figure 7A:
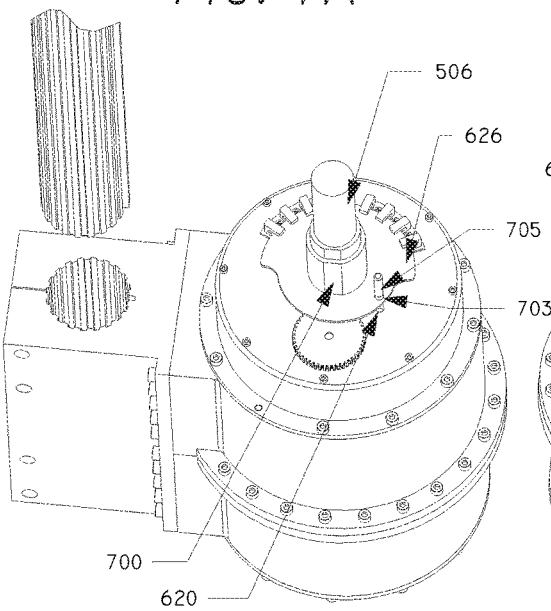
FIG. 7A is a close-up view of the remote azimuth steering components according to one embodiment of the present invention.

As shown in FIG. 7A, the output shaft disc 626 may be passed through the output shaft 506 and fixedly attached to the latter. The output shaft disc 626 and the output shaft 506 may include provisions so that the two parts may be engaged in a unique orientation. Said provisions may be of several varieties, such as a single flat or double flat output shaft 700 and a mating single flat or double flat cavity (not shown) on the output shaft disc 626. It is to be understood that other engagement and alignment means may be incorporated and are within the scope of the present invention, and that therefore this description is not to be limited to any one engagement or alignment means discussed herein.

Figure 7B:
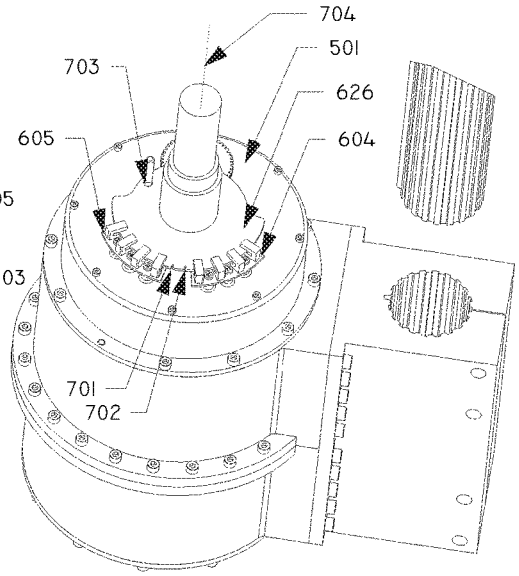
FIG. 7B is another further close-up view of the remote azimuth steering unit components according to one embodiment of the present invention.

As shown in FIG. 7B, the output shaft disc 626 may have a minimum azimuth offset limit slot 701 and a maximum azimuth offset slot 702, with respect to the output shaft disc alignment bore 703. One or more minimum azimuth offset optical limit switches 604 and maximum azimuth offset optical limit switches 605 are mounted on the lower top housing 501 with respect to the output shaft disc alignment bore 703. When the antenna array 100 is within the allowable clockwise and counterclockwise rotational motion range, the minimum azimuth offset optical limit switches 604 and maximum azimuth offset optical limit switches 605 emitter beams are blocked by the output shaft disc 626. As the output shaft disc 626 rotates around output shaft rotation axis 704, the minimum azimuth offset optical limit switches 604 and maximum azimuth offset optical limit switches 605 output signal changes when either a minimum azimuth offset limit slot 701 or a maximum azimuth offset slot 702 is encountered, indicating that either the minimum azimuth offset or maximum azimuth offset has been reached.

To preset the encoder (not shown) at the preferred reference position so that the output azimuthal position is reported with reference to this value, position retaining means may also be incorporated in the output shaft disc 626 and the lower top housing 501. For example, as shown in FIG. 7A, the output shaft disc 626 may be secured to the preferred reference position by tightly fitting an alignment pin 705 through the output shaft disc alignment bore 703 and the lower top housing alignment bore 620. The encoder stores this preset value into internal memory and indicates the new position information with reference to this preset value every time data is read out.

Returning to FIG. 6, once the output shaft 506 is fixedly attached to the output shaft disc 626 and aligned with the lower top housing 501, the second stage speed reduction arrangement mounting flange 627 may be fixedly attached to the output shaft 506 by threads (not shown) and two counter nuts 628. Once the second stage speed reduction arrangement mounting flange 627 is fixedly attached to the output shaft 506, the second stage speed reduction arrangement 615 may be attached and aligned to the second stage speed reduction arrangement mounting flange 627. As shown in FIG. 6, the second stage speed reduction arrangement mounting flange 627 and the second stage speed reduction arrangement 615 may include provisions so that the two parts may be engaged in a unique orientation. Said provisions may be of several varieties, such as inserting a key 629 through a single flat or double flat hole on the second stage speed reduction arrangement mounting flange 627 and the second stage speed reduction arrangement top plate 630. A skilled reader will recognize that alternative alignment provisions may be incorporated in the present invention, and therefore the present invention is not to be limited to any one alignment provision discussed herein. Once the second stage speed reduction arrangement 615 has been attached and aligned to the second stage speed reduction arrangement mounting flange 627, the first stage speed reduction arrangement 607 may be directly coupled to the second stage speed reduction arrangement 615 using a suitable high rigidity coupling plate 616. The actuator output shaft 612 may be operatively connected to the first stage speed reduction arrangement 607 using a suitable high rigidity coupling plate 613. Once all aforementioned parts are coupled and aligned, controlled revolution of the actuator output shaft 612 may successively rotate the first stage speed reduction arrangement 607 according to a first gearing reduction ratio, the second stage speed reduction arrangement 615 according to a second gearing reduction ratio, providing rotation of the output shaft 506 according to a third reduction ratio around the output shaft rotation axis 704, with respect to the lower top housing alignment bore 620.

As previously mentioned, with reference to FIGS. 5A and 5B, a coupler 331 may be permanently fixed to the remote azimuth steering unit output shaft 506 using a coupler mounting flange 507, providing means to engage the remote azimuth steering arrangement rotating pole 329 with the remote azimuth steering unit 330.

Figure 7C:
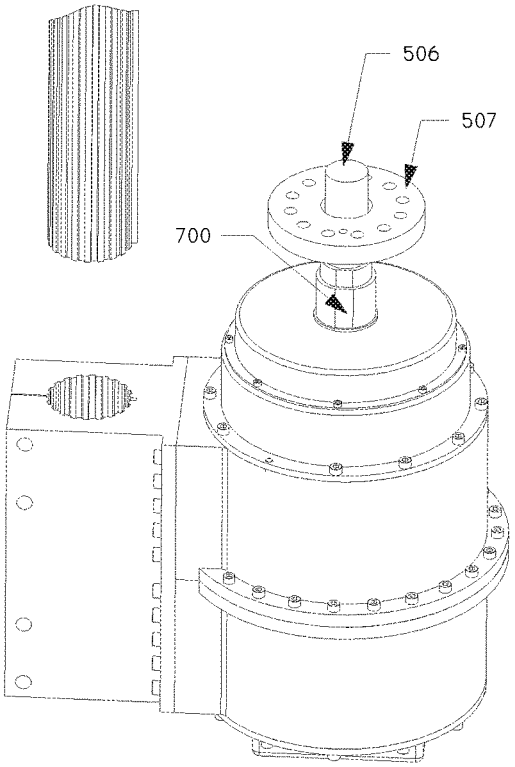
FIG. 7C is a further close-up view of the remote azimuth steering unit components according to one embodiment of the present invention.

Turning to FIG. 7C, the remote azimuth steering unit output shaft 506 and coupler mounting flange 507 may include provisions so that the two parts may be engaged in a unique orientation. Said provisions may be of several varieties, such as a single flat or double flat output shaft 700 and a mating single flat or double flat cavity on the coupler mounting flange. It is to be understood that alternative alignment provisions may be incorporated and are within the scope of the present invention, and that therefore this description is not to be limited to any one alignment provision discussed herein.

Figure 8:
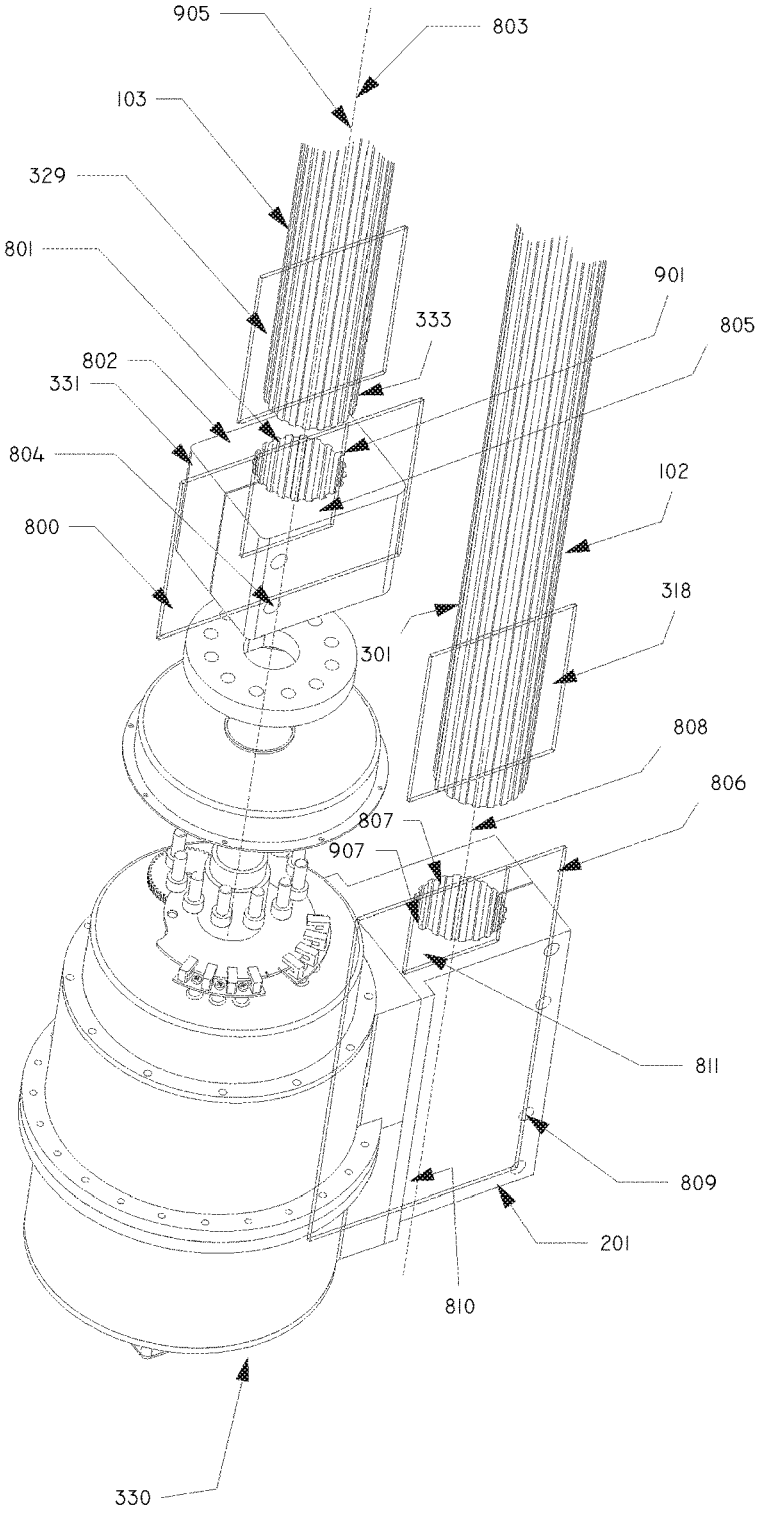
FIG. 8 is a close-up, exploded view of alignment of rotating remote azimuth steering unit components with respect to an alignment bore according to one aspect of the present invention.

Referring to FIG. 8, the coupler 331 may generally be cuboid shaped having an upper wall, a lower wall, a front wall, a rear wall and two sidewalls. The coupler 331 may generally be symmetrical about a longitudinal (vertical) bisectional plane 800. The upper wall, the lower wall, the front wall, the rear wall and the sidewalls may preferably be flat.

Figure 7D:
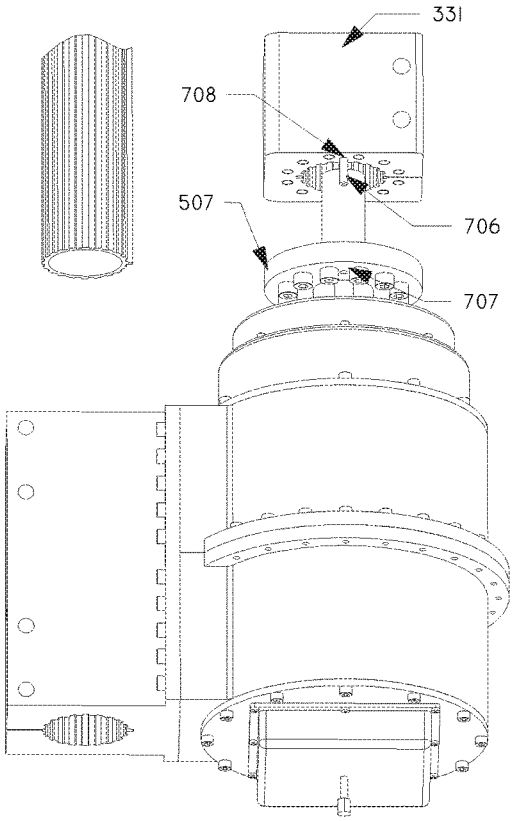
FIG. 7D is a further close-up view of the remote azimuth steering unit components according to one embodiment of the present invention.

As shown in FIG. 7D, the coupler 331 and coupler mounting flange 507 may include provisions so that the two parts may be engaged in a unique orientation. Said provisions may be of several varieties, such as tightly fitting a key 706 through the coupler mounting flange alignment bore 707 and the coupler alignment bore 708. A skilled reader will recognize that alternative alignment provisions may be incorporated in the present invention, and therefore the present invention is not to be limited to any one alignment provision discussed herein.

Referring back to FIG. 8 an elongated electromechanical remote azimuth steering arrangement rotating pole fitting cavity 801 may be formed from the coupler upper wall to the opposite coupler lower wall (not shown). The rotating pole fitting cavity shape may preferably be tubular with splines having a central axis at a predefined offset from the rear wall and sidewalls.

Figure 9A:
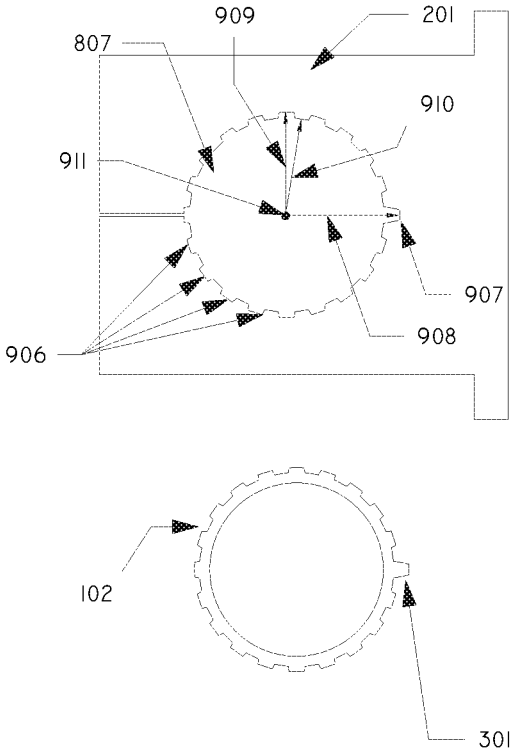
FIG. 9A is a cross-sectional view of a mounting brace and a backbone pole according to an embodiment of the present invention.
Figure 9B:
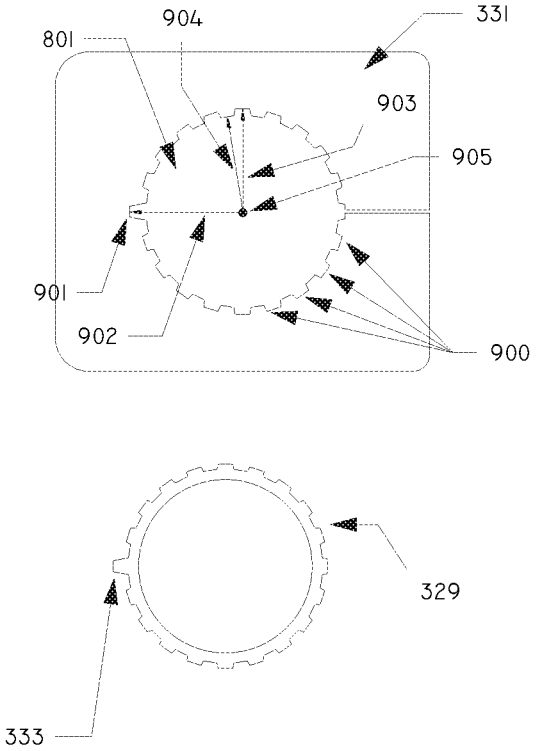
FIG. 9B is a cross-sectional view of a coupler and a rotating pole according to an embodiment of the present invention.

FIG. 9B presents a cross sectional view of the coupler 331 and the rotating pole 329 according to one embodiment of the present invention. The coupler rotating pole fitting cavity 801 may include a spline twist prevention formation 900, for firmly interlocking the electromechanical remote azimuth steering arrangement rotating pole 329 to the remote azimuth steering unit 330, and an alignment formation 901, for aligning the relative position of the electromechanical remote azimuth steering arrangement rotating pole 329 with respect to the first linkage arm and the second linkage arm 200. The spline twist prevention formation has a plurality of regularly spaced recesses, preferably rectangular shaped, extending along the entire length of the elongated cavity 801. The alignment formation has a recess, preferably rectangular shaped having different dimensions than the twist prevention formation recesses, extending along the length of the elongated cavity 801. The rotating pole fitting cavity 801 has a first cross-sectional radius 902 at the alignment formation recess, a second cross-sectional radius 903 at the twist prevention formation recesses and a third cross-sectional radius 904 at an angle from the second cross-sectional radius 903. The first cross-sectional radius 902 is larger than the second cross-sectional radius 903 by the difference in height of the alignment formation recess and the twist prevention formation recesses. The second cross-sectional radius 903 is larger than the third cross-sectional radius 904 by the height of the twist prevention formation recesses. Three concentric cross-sectional circular planes may be defined using the aforementioned cross-sectional radiuses. The cross-sectional circular planes may have a common central axis 905 that is collinear with the rotating pole fitting cavity central axis 803, lying on the longitudinal (vertical) bisectional plane 800, as shown in FIG. 8.

Continuing to refer to FIG. 8, the coupler 331 may include a locking mechanism 804. The locking mechanism 804 may be operable to secure the electromechanical remote azimuth steering arrangement rotating pole 329 on the remote azimuth steering unit 330. The locking mechanism 801 may be of several varieties, such as a set of screws or a lever. The mechanism 801 may be engaged in a manner whereby the locking mechanism 801 is tightened, pushing the rotating pole fitting cavity inner surface area against the electromechanical remote azimuth steering rotating pole outer surface area to create additional tightness. A skilled reader will recognize that other securing mechanisms may be incorporated in the present invention, and therefore the present invention is not to be limited to any one securing or locking mechanism discussed herein.

As shown in FIG. 8, the coupler 331 may be slideably engaged to the rotating pole 329 in a unique orientation by means of an alignment formation comprising an index recess 901 and a mating index protrusion 333. A skilled reader will recognize that other engagement and alignment means may be incorporated in the present invention, and therefore the present invention is not to be limited to any one engagement or alignment means discussed herein.

Figure 4E:
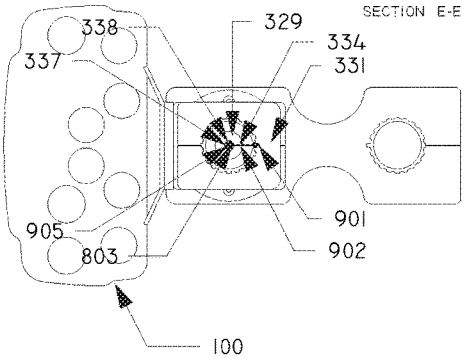
FIG. 4E is a cross-sectional view of the two-way antenna mounting bracket assembly of the present invention taken along line E-E of FIG. 2.

FIG. 4E illustrates a cross-sectional view of the two-way antenna mounting bracket assembly 101 taken along line E-E of FIG. 2. As shown in FIG. 4E, an assembly comprising the coupler 331 engaged to the remote azimuth steering unit 330 and the rotating pole 329 may be positioned in a third reference position. In the said third reference position, the rotating pole first cross sectional radius 334 axis at the alignment formation protrusion is collinear with the coupler rotating pole fitting cavity cross sectional radius axis 902 at the alignment formation 901 recess and perpendicular to the back wall of the antenna array 100. Furthermore, in the said third reference position, the rotating pole fitting cavity cross sectional central axis 905 is collinear with the rotating pole fitting cavity central axis 803, the rotating pole cross sectional central axis 337 and the rotating pole central axis 338, lying on the longitudinal (vertical) bisectional plane (not shown).

Similarly, in the said third reference position, as shown in FIG. 8, the points lying on the rotating pole first cross sectional radius axis vertical plane 339 at the alignment formation 333 protrusion and the coupler rotating pole fitting cavity first cross sectional radius axis vertical plane 805 at the alignment formation recess define a third reference position plane. The third reference position plane and the coupler longitudinal (vertical) bisectional plane are coincident and perpendicular to the back wall of the antenna array 100.

It should be noted that the descriptive terms top and bottom, upper and lower, and front and back and the like are used to aid in the description of the embodiments as shown in the drawings and are not intended to limit the embodiment or any of its parts orientation in space.

In this manner, as shown in FIG. 3A and FIG. 3B, the first linkage arm and the second linkage arm 200 may be engaged to both the stationary backbone pole 102, the rotating pole 329 of the electromechanical remote azimuth steering arrangement 103, and the remote azimuth steering unit 330, in a unique orientation defined by the first linkage arm and second linkage arm longitudinal (vertical) bisectional plane 307 which is coincident with the first reference position plane, the second reference position plane, the third reference position plane and perpendicular to the back wall of the antenna array 100.

As previously mentioned, with reference to FIG. 3A and 3B, a mounting brace 201 may fit over the outer diameter of the stationary backbone pole 102 and may be permanently fixed to the remote azimuth steering unit 330, providing means to engage the latter and the remote azimuth steering arrangement 103 with the backbone pole 102.

Referring to FIG. 8, the mounting brace 201 may generally be cuboid shaped having an upper wall, a lower wall, a front wall, a rear wall and two sidewalls. The mounting brace 201 may generally be symmetrical about a longitudinal (vertical) bisectional plane 806. The upper wall, the lower wall, the front wall, the rear wall and the sidewalls may preferably be flat. An elongated backbone pole fitting cavity 807 may be formed from the mounting brace upper wall to the opposite mounting brace lower wall (not shown). The backbone pole fitting cavity shape may preferably be tubular with splines having a central axis at a predefined offset from the rear wall and sidewalls.

FIG. 9A presents a cross-sectional view of the mounting brace 201 and the backbone pole 102 according to one embodiment of the present invention. The mounting brace backbone pole fitting cavity 807 may include a spline twist prevention formation 906, for firmly interlocking the backbone pole 102 to the mounting brace 201, and an alignment formation 907, for aligning the relative position of the backbone pole 102 with respect to the first linkage arm and the second linkage arm 200. The spline twist prevention formation has a plurality of regularly spaced recesses, preferably rectangular shaped, extending along the entire length of the elongated cavity. The alignment formation includes a recess, preferably rectangular shaped having different dimensions than the twist prevention formation recesses, extending along the length of the elongated cavity. The backbone pole fitting cavity has a first cross-sectional radius 908 at the alignment formation recess, a second cross-sectional radius 909 at the twist prevention formation recesses and a third cross-sectional radius 910 at an angle from the second cross-sectional radius 909. The first cross-sectional radius 908 is larger than the second cross-sectional radius 909 by the difference in height of the alignment formation recess and the twist prevention formation recesses. The second cross-sectional radius 908 is larger than the third cross-sectional radius 909 by the height of the twist prevention formation recesses. Three concentric cross-sectional circular planes may be defined using the aforementioned cross-sectional radiuses. The said cross-sectional circular planes may have a common central axis 911 that is collinear with the backbone pole fitting cavity central axis 808, lying on the longitudinal (vertical) bisectional plane 806, as shown in FIG. 8.

Continuing to refer to FIG. 8, the mounting brace 201 may include a first locking mechanism 809. This locking mechanism 809 may be operable to secure the backbone pole 102 on the mounting brace 201. The locking mechanism 809 may be of several varieties, such as a set of screws or a lever. The mechanism 809 may be engaged in a manner whereby the locking mechanism 809 is tightened, pushing the backbone pole fitting cavity inner surface area against the backbone pole outer surface area to create additional tightness. A skilled reader will recognize that other securing mechanisms may be incorporated in the present invention, and therefore the present invention is not to be limited to any one securing or locking mechanism discussed herein.

With further reference to FIG. 8, the mounting brace 201 may include a second locking mechanism 810. This locking mechanism 810 may be operable to secure the remote azimuth steering unit 330 on the mounting brace 201. The locking mechanism 810 may be of several varieties, such as a set of screws or a lever. The mechanism may be engaged in a manner whereby the locking mechanism 810 is tightened, fixedly attaching the mounting brace front wall to the upper middle housing and the lower middle housing. A skilled reader will recognize that other securing mechanisms may be incorporated in the present invention, and therefore the present invention is not to be limited to any one securing or locking mechanism discussed herein.

As shown in FIG. 8, the mounting brace 201 may be slideably engaged to the backbone pole 102 in a unique orientation by means of an alignment formation comprising an index recess 907 and a mating index protrusion 301. A skilled reader will recognize that other engagement and alignment means may be incorporated in the present invention, and therefore the present invention is not to be limited to any one alignment means discussed herein.

Figure 4F:
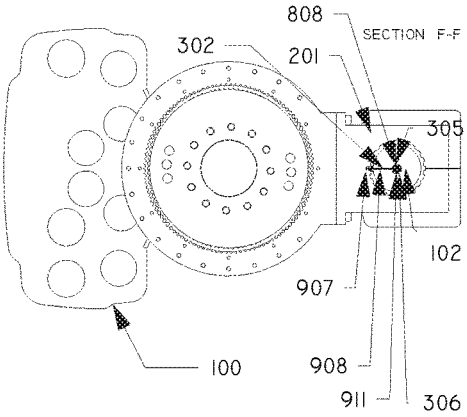
FIG. 4F is a cross-sectional view of the two-way antenna mounting bracket assembly of the present invention taken along line F-F of FIG. 2.

FIG. 4F illustrates a cross-sectional view of the two-way antenna mounting bracket assembly 101 taken along line F-F of FIG. 2. As shown in FIG. 4F, an assembly comprising mounting brace 201 engaged to the remote azimuth steering unit 330 and the backbone pole 102 may be positioned in a fourth reference position. In the said fourth reference position, the backbone pole first cross-sectional radius 302 axis at the alignment formation protrusion is collinear with the mounting brace backbone pole fitting cavity first cross-sectional radius axis 908 at the alignment formation 907 recess and perpendicular to the back wall of the antenna array 100. Furthermore, in the said fourth reference position, the backbone pole fitting cavity cross-sectional central axis 911 is collinear with the backbone pole fitting cavity central axis 808, the backbone pole cross-sectional central axis 305 and the backbone pole central axis 306, lying on the longitudinal (vertical) bisectional plane (not shown).

Similarly, in the said fourth reference position, as shown in FIG. 8, the points lying on the backbone pole first cross sectional radius axis vertical plane 318 at the alignment formation 301 protrusion and the mounting brace backbone pole fitting cavity first cross-sectional radius axis vertical plane 811 at the alignment formation recess define a fourth reference position plane. The said third reference position plane and the mounting brace longitudinal (vertical) bisectional plane are coincident and perpendicular to the back wall of the antenna array 100.

It should be noted that the descriptive terms top and bottom, upper and lower, and front and back and the like are used to aid in the description of the embodiments as shown in the drawings and are not intended to limit the embodiment or any of its parts orientation in space.

In this manner, as shown in FIG. 3A and FIG. 3B, the first linkage arm and the second linkage arm 200 may be engaged to both the stationary backbone pole 102, the rotating pole 329 of the electromechanical remote azimuth steering arrangement 103, the remote azimuth steering unit 330 and the mounting brace 201, in a unique orientation defined by the first linkage arm and second linkage arm longitudinal (vertical) bisection plane 307 which is coincident with the first reference position plane, the second reference position plane, the third reference position plane, the fourth reference position plane and perpendicular to the back wall of the antenna array 100.

Returning to FIG. 2, the electromechanical remote azimuth steering arrangement 103 may further include a first antenna mounting brace 202 and a second antenna mounting brace 202 that are fit over the outer diameter of the rotating pole 329 of the electromechanical remote azimuth steering arrangement 103, as shown in FIG. 3A, providing means to attach the antenna array 100 to the latter. It will be appreciated by those skilled in the art that the same reference designator 202 may be used to refer to both the first antenna mounting brace and second antenna mounting brace interchangeably.

Details pertaining to first antenna mounting brace and the second antenna mounting brace 202 are shown in FIG. 3B. The first antenna mounting brace and the second antenna mounting brace 202 may generally be cuboid shaped having an upper wall, a lower wall, a front wall, a rear wall and two sidewalls. The first antenna mounting brace and the second antenna mounting brace 202 may generally be symmetrical about a longitudinal (vertical) bisection plane 341. The upper wall, the lower wall, the front wall, the rear wall and the sidewalls may preferably be flat.

Figure 9C:
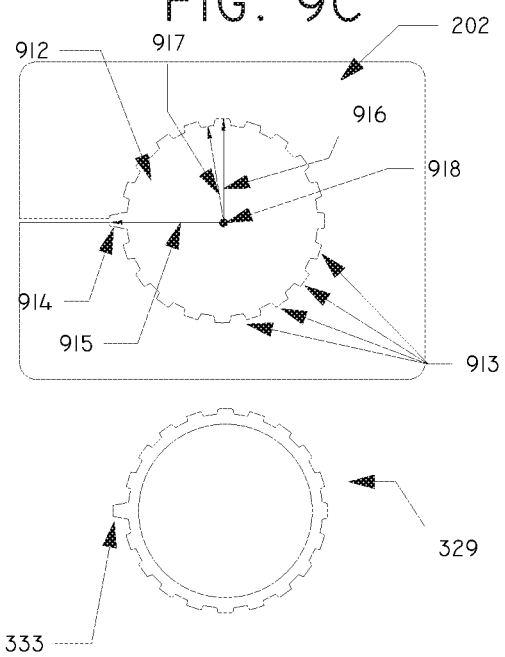
FIG. 9C is a cross-sectional view of a mounting brace and a rotating pole according to an embodiment of the present invention.

FIG. 9C shows a cross section view of the first antenna mounting brace and the second antenna mounting brace 202. An elongated rotating pole fitting cavity 912 may be formed from the first antenna mounting brace upper wall to the opposite antenna mounting brace lower wall and from the second antenna mounting brace upper wall to the opposite second antenna mounting brace lower wall. The rotating pole fitting cavity shape may preferably be tubular with splines having a central axis at a predefined offset from the rear wall and sidewalls.

With further reference to FIG. 9C, the rotating pole fitting cavity 912 may include a spline twist prevention formation 913, for firmly interlocking the rotating pole 329 of the electromechanical remote azimuth steering arrangement 103 to the first antenna mounting brace and the second antenna mounting brace 202, and an alignment formation 914, for aligning the relative position of the rotating pole 329 with respect to the first antenna mounting brace and the second antenna mounting brace 202. The spline twist prevention formation consists essentially of a plurality of regularly spaced recesses, preferably rectangular shaped, extending along the entire length of the elongated cavity. The alignment formation includes a recess, preferably rectangular shaped having different dimensions than the twist prevention formation recesses, extending along the length of the elongated cavity. The rotating pole fitting cavity has a first cross-sectional radius 915 at the alignment formation recess, a second cross-sectional radius 916 at the twist prevention formation recesses and a third cross-sectional radius 917 at an angle from the second cross-sectional radius. The first cross-sectional radius 915 is larger than the second cross-sectional radius 916 by the difference in height of the alignment formation recess and the twist prevention formation recesses. The second cross-sectional radius 916 is larger than the third cross-sectional radius 917 by the height of the twist prevention formation recesses. Three concentric cross-sectional circular planes may be defined using the aforementioned cross-sectional radiuses. The said cross-sectional circular planes may have a common central axis 918 that is collinear with the rotating pole fitting cavity central axis 342, lying on the longitudinal (vertical) bisectional plane 341, as shown in FIG. 3B.

Referring back to FIG. 3B, the first antenna mounting brace and the second antenna mounting brace 202 may include a locking mechanism 343. This locking mechanism 324 may be operable to fixedly attach the first antenna mounting brace and the second antenna mounting brace 202 at a particular position along the rotating pole 329, once they are slideably coupled to the latter. The locking mechanism 324 may be of several varieties, such as a set of screws or a lever. The mechanism may be engaged in a manner whereby the locking mechanism 324 is tightened, pushing the first antenna mounting brace rotating pole fitting cavity inner surface area and the second antenna mounting brace rotating pole fitting cavity inner surface area against the electromechanical remote azimuth steering rotating pole outer surface area to create additional tightness. A skilled reader will recognize that other securing mechanisms may be incorporated in the present invention, and therefore the present invention is not to be limited to any one locking or securing mechanism discussed herein.

As shown in FIG. 3B, the first antenna mounting brace and the second antenna mounting brace 202 may be slideably engaged to the rotating pole 329 in a unique orientation by means of an alignment formation comprising an index recess 914 and a mating index protrusion 333. A skilled reader will recognize that other engagement and alignment means may be incorporated in the present invention, and therefore the present invention is not to be limited to any one alignment means discussed herein.

FIG. 4A and FIG. 4D illustrate two cross-sectional views of the two-way antenna mounting bracket assembly 101 taken along lines A-A and D-D of FIG. 2. As shown in FIG. 4A, an assembly comprising a first antenna mounting brace 202 and a rotating pole 329 may be slideably engaged and positioned in a fifth reference position. In the same manner, as shown in FIG. 4D, an assembly comprising a second antenna mounting brace 202 and the said rotating pole 329 may be slideably engaged and positioned in the said fifth reference position. With further reference to FIG. 4A and FIG. 4D, in the said fifth reference position, the rotating pole first cross-sectional radius 334 axis at the alignment formation 333 protrusion is collinear with first antenna mounting brace and the second antenna mounting brace first cross-sectional radius 915 axis at the alignment formation 914 recess and perpendicular to the back wall of the antenna array 100. Furthermore, in the said fifth reference position, the rotating pole fitting cavity cross-sectional central axis 918 is collinear with the rotating pole fitting cavity central axis 342, the rotating pole cross-sectional central axis 337 and the rotating pole central axis 338, lying on the longitudinal (vertical) bisection plane (not shown). Similarly, in the said fifth reference position, as shown in FIG. 3B, the points lying on the rotating pole first cross-sectional radius axis vertical plane 339 at the alignment formation 333 protrusion and the first antenna mounting brace and the second antenna mounting brace first cross-sectional radius axis vertical plane 343 at the alignment formation 914 recess define a fifth reference position plane. The said fifth reference position plane and the first antenna mounting brace and the second antenna mounting brace longitudinal (vertical) bisectional plane are coincident and perpendicular to the back wall of the antenna array 100.

It should be noted that the descriptive terms top and bottom, upper and lower, and front and back and the like are used to aid in the description of the embodiments as shown in the drawings and are not intended to limit the embodiment or any of its parts orientation in space.

In this manner, as shown in FIG. 3A and FIG. 3B, the first antenna mounting brace and the second antenna mounting brace 202 as well as the first linkage arm and the second linkage arm 200 may be engaged to both the stationary backbone pole 102, the electromechanical remote azimuth steering arrangement 103 rotating pole 329, the remote azimuth steering unit 330 and the mounting brace 201, in a unique orientation defined by the first linkage arm and second linkage arm longitudinal (vertical) bisectional plane 307 which is coincident with the first reference position plane, the second reference position plane, the third reference position plane, the fourth reference position plane, the fifth reference position plane and perpendicular to the back wall of the antenna array 100. FIG. 6 illustrates provisions for manual azimuth angle adjustment. Manual operation may be desirable when remote control may be unavailable or when an electrical mechanism may malfunction. Manual antenna array azimuth angle adjustment can be accomplished by rotating the manual azimuth adjustment knob 631 coupled to the dual-shaft motor rear shaft in a clockwise or counterclockwise direction. It should be understood that the high resolution single turn absolute encoder remains coupled to the output shaft during manual azimuth adjustment and reports absolute positional information with respect to a reference position so that antenna array beam azimuth calibration is retained.

With further reference to FIG. 1, an Alignment Sensor Device (ASD) 105 is permanently mounted on the top antenna mounting flange ensuring that the specified array alignment does not change over time by constantly monitoring the antenna array's azimuth, tilt and roll in real-time. The ASD 105 includes a GPS-based compass with an integrated inclinometer that provides accurate True or Grid North azimuth, sub-meter GPS or UTM position and inclination data without being affected by local magnetic interference. The antenna array and the ASD coordinate systems coincide and therefore the respective antenna array and ASD azimuth, tilt and roll axis are parallel. As such, any antenna array angular tilt with respect to the horizon is consistently and accurately reported. By complying with the AISG communications standard, the ASD 105 can report current antenna array alignment to any Remote Azimuth Steering (RAS), Remote Mechanical Tilt (RMT) or Remote Electrical Tilt (RET) controller, thus accelerating troubleshooting and radio site optimization.

Electromechanical Tilting Function

Figure 10:
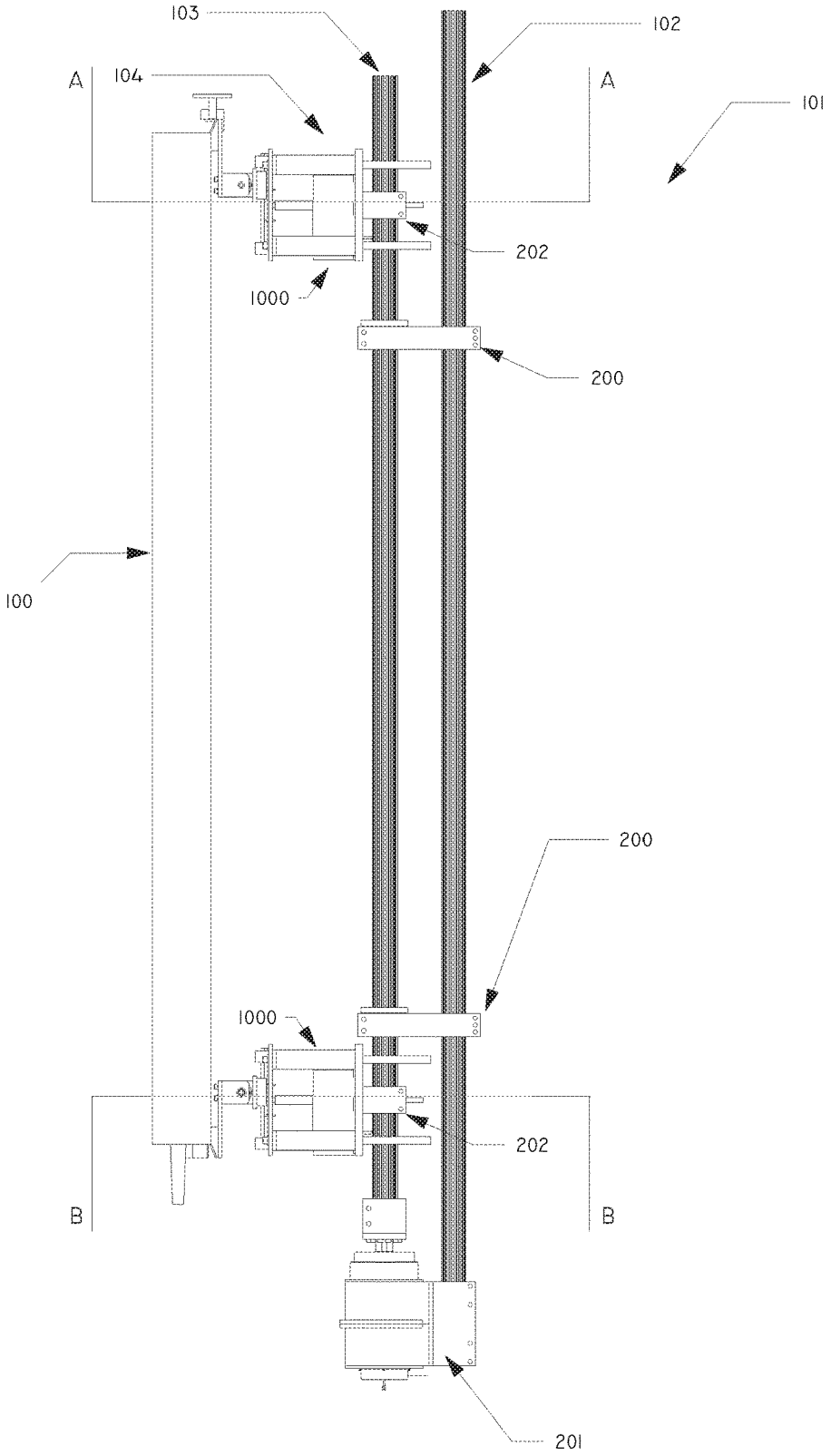
FIG. 10 is a side view of a two-way antenna mounting bracket and assembly having an electromechanical remote mechanical tilt arrangement coupled to an electromechanical remote azimuth steering arrangement according to one embodiment of the present invention.

FIG. 10 shows a side view of the two-way antenna mounting bracket assembly 101 according to another embodiment of the present invention, which may feature a first mode of operation providing angular adjustment of the antenna beam azimuth and a second mode of operation providing angular adjustment of the antenna tilt. In this embodiment, the two-way antenna mounting bracket assembly 101 may include an electromechanical remote mechanical tilt arrangement 104 coupled to the electromechanical remote azimuth steering arrangement 103. Preferably, the electromechanical remote mechanical tilt arrangement 104 may be attached to the electromechanical remote azimuth steering arrangement 103 using the first antenna mounting brace and second antenna mounting brace 202. It will be appreciated by those skilled in the art that the same reference designator 202 may be used to refer to both first antenna mounting brace and the second antenna mounting brace interchangeably.

Figure 11B:
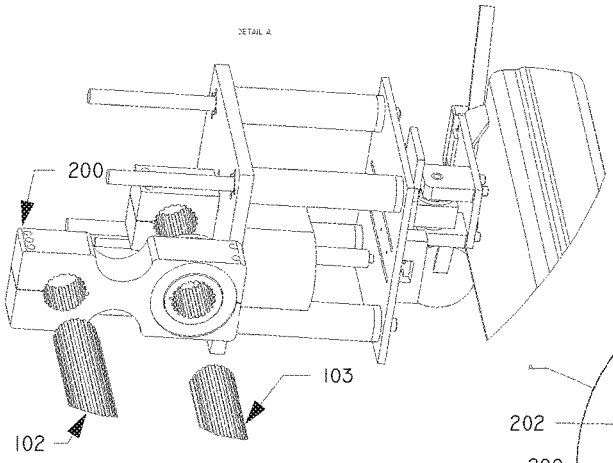
FIG. 11B is a further close-up view of components of the electromechanical tilting arrangement in the two-way antenna mounting bracket and assembly of the present invention.
Figure 11A:
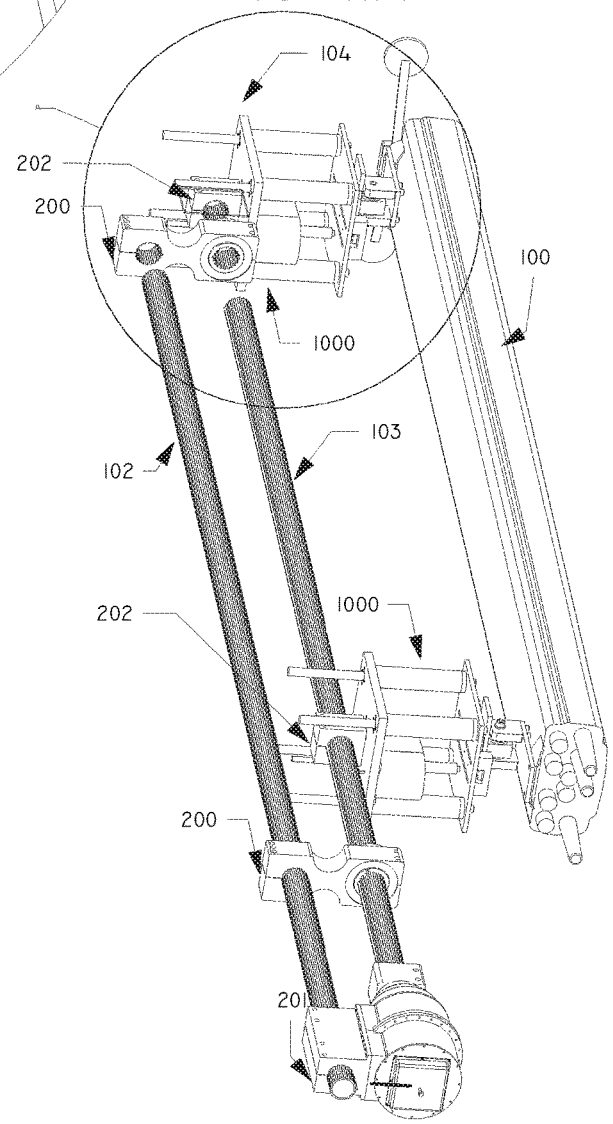
FIG. 11A is a close-up view of the electromechanical tilting arrangement and electromechanical remote azimuth steering arrangement in the two-way antenna mounting bracket and assembly of the present invention.
Figure 11C:
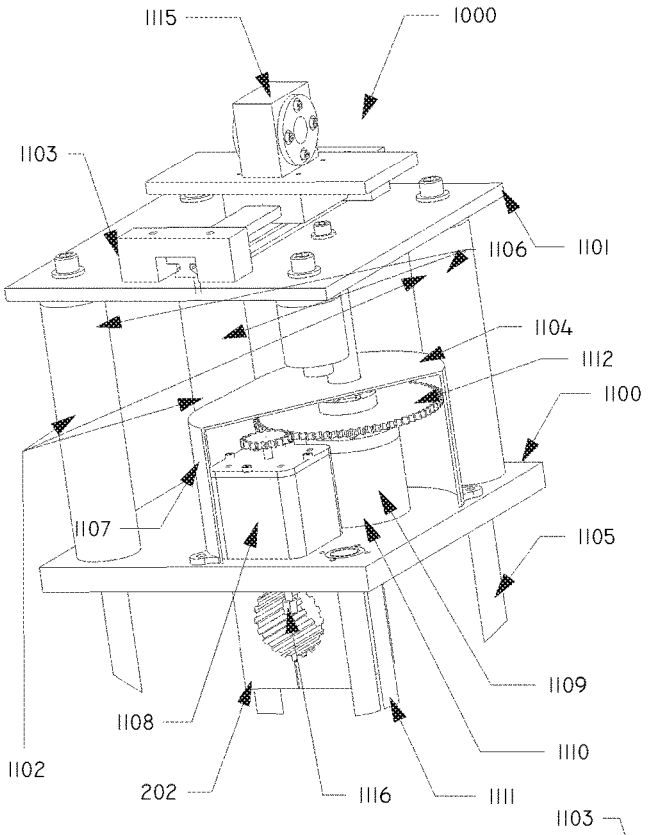
FIG. 11C is a perspective cross-sectional view of electromechanical remote mechanical tilt brackets according to one aspect of the present invention.

The electromechanical remote azimuth steering arrangement 103 may be attached to the backbone pole 102 using a first linkage arm and an alike second linkage arm 200, and a mounting brace 201 that are fit over the outer diameter of the stationary backbone pole, as shown in FIG. 11A and FIG. 11C. It will be appreciated by those skilled in the art that the same reference designator 200 may be used to refer to both the first linkage arm and second linkage arm interchangeably.

As shown in FIG. 10, the electromechanical remote mechanical tilt arrangement 104 may comprise a first electromechanical remote mechanical tilt bracket and an alike second electromechanical remote mechanical tilt bracket 1000 that are perpendicularly attached to the first antenna mounting brace and second antenna mounting brace 202, respectively.

With further reference to FIG. 10, first antenna mounting brace and second antenna mounting brace 202 may further include a second locking mechanism (not shown). This mechanism may be engaged in a manner whereby the locking mechanism is tightened, fixedly attaching first antenna mounting brace and second antenna mounting brace 202 front wall perpendicularly to the first electromechanical remote mechanical tilt bracket and the second electromechanical remote mechanical tilt bracket 1000, respectively. The locking mechanism may be of several varieties, such as a set of screws or a lever. A skilled reader will recognize that other securing mechanisms may be incorporated in the present invention, and therefore the present invention is not to be limited to any one securing or locking mechanism discussed herein.

Details pertaining to the first electromechanical remote mechanical tilt bracket and the second electromechanical remote mechanical tilt bracket 1000 are shown in FIG. 11C. The first electromechanical remote mechanical tilt bracket and the second electromechanical remote mechanical tilt bracket 1000 may comprise a stationary back plate 1100, a moving front plate 1101 offset therefrom and a plurality of telescopic mechanisms 1102.

FIG. 11C shows a perspective cross-sectional view of the first electromechanical remote mechanical tilt bracket and the second electromechanical remote mechanical tilt bracket 1001 perpendicularly attached to a first antenna mounting brace and second antenna mounting brace 202. The first electromechanical remote mechanical tilt bracket and the second electromechanical remote mechanical tilt bracket 1001 may further include a profile rail guide mechanism

1103, an electromechanical drive system 1104, and an antenna hinge attachment block 1115.

The stationary back plate 1100 may generally be rectangular shaped including a plurality of holes for attaching the electromechanical drive system 1104, the first antenna mounting brace and second antenna mounting brace 202 and the telescopic mechanism 1102. The stationary back plate 1100 may further include a plurality of holes or slots through which the telescopic mechanism 1102 rod 1105 may be passed.

With further reference to FIG. 11C, the moving front plate 1101 may generally be rectangular shaped including a plurality of holes for attaching the profile rail guide mechanism 1103, the telescopic mechanism 1102 and the electromechanical drive system 1104.

The telescopic mechanisms 1102 may comprise a cylinder 1106, a rod 1105 and a guide (not shown). The rod 1105 may be housed in the cylinder 1106 and may be extendable and retractable in a particular direction with respect to a base. In one embodiment, the base may be the stationary back plate 1100. The cylinder 1106 may further incorporate a guide (not shown) to constrain and guide the rod 1105 inside the cylinder and to reduce energy lost due to friction.

Continuing to refer to FIG. 11C, the electromechanical drive system 1104 may preferably include an electromechanical drive system housing 1107, an actuator-gearbox assembly 1108 and a gearbox—ball screw assembly 1109.

The actuator may be a high speed, low torque motor dual shaft stepper motor to minimize the required electrical power consumption and to maintain manual control over antenna array mechanical tilt if such need may arise in case of malfunction or electrical power failure. The gearbox assembly 1108 may comprise a single or multiple spur gears. A skilled reader will recognize that other motor-gearbox configurations may be incorporated in the apparatus of the present invention, and therefore the present invention is not to be limited to any one configuration discussed herein.

The gearbox—ball screw assembly 1109 may preferably include a ball screw housing 1110, a screw 1111, a nut (not shown), a ball-bearing return mechanism (not shown) and a single or multiple spur gears 1112. The screw 1111 may have a helical groove along the length of its shaft, and the nut (not shown) may include a matching groove. Said grooves may act as the inner and outer races along which precision metal balls may travel to produce linear motion.

Figure 11D:
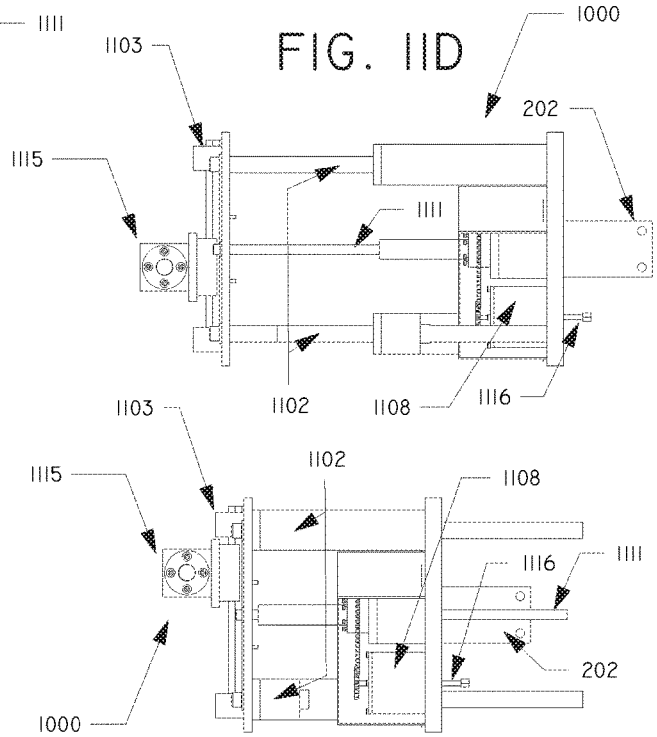
FIG. 11D is two side views of electromechanical remote mechanical tilt brackets according to one aspect of the present invention.

Rotation of the motor output shaft 1113 and gear 1114 coupled thereto may provide rotation to the gearbox—ball screw assembly 1109. Gearbox—ball screw assembly 1109 gear 1112 rotary motion is translated into linear motion extending or retracting the screw 1111, providing position control and reverse load sustaining of the moving front plate 1101. Linear motion of the moving front plate 1101 extends or retracts the telescopic mechanisms 1102 coupled thereto. FIG. 11D shows a side view of the electromechanical remote mechanical tilt arrangement 104 in a fully retracted position. Similarly, FIG. 11E shows a side view of the electromechanical remote mechanical tilt arrangement 104 in a fully extended position.

As shown in FIG. 11C, a profile rail guide mechanism 1103 may be fixed on the moving front plate 1101 to translate horizontal moving front plate motion to vertical displacement. The antenna hinge attachment block 1115 may be operatively attached to the rail guide mechanism 1103 for translating vertical displacement to downward or upward elliptical displacement and for attaching different types of antenna clamps on the two-way antenna mounting bracket assembly 101.

The electromechanical remote mechanical tilt arrangement 104 may further include a remote mechanical tilt (RMT) board 1300, as discussed with reference to FIG. 13, to control the first electromechanical remote mechanical tilt bracket and the second electromechanical remote mechanical tilt bracket 1000. The remote mechanical tilt (RMT) board 1300 may comprise a microprocessor and a plurality of integrated circuits that control the electromechanical drive system and the Antenna Interface Standards Group (AISG) communication interface. Male and female AISG connectors may be incorporated to facilitate daisy-chained device connection on a single RS bus.

FIG. 11C illustrates provisions for manual mechanical tilt angle adjustment. Manual operation may be desirable when remote control may be unavailable or when an electrical mechanism malfunctions. Manual antenna array mechanical tilt angle adjustment can be accomplished by rotating the manual mechanical tilt adjustment knob 1116 coupled to the dual-shaft motor rear shaft in a clockwise or counterclockwise direction.

Figure 12:
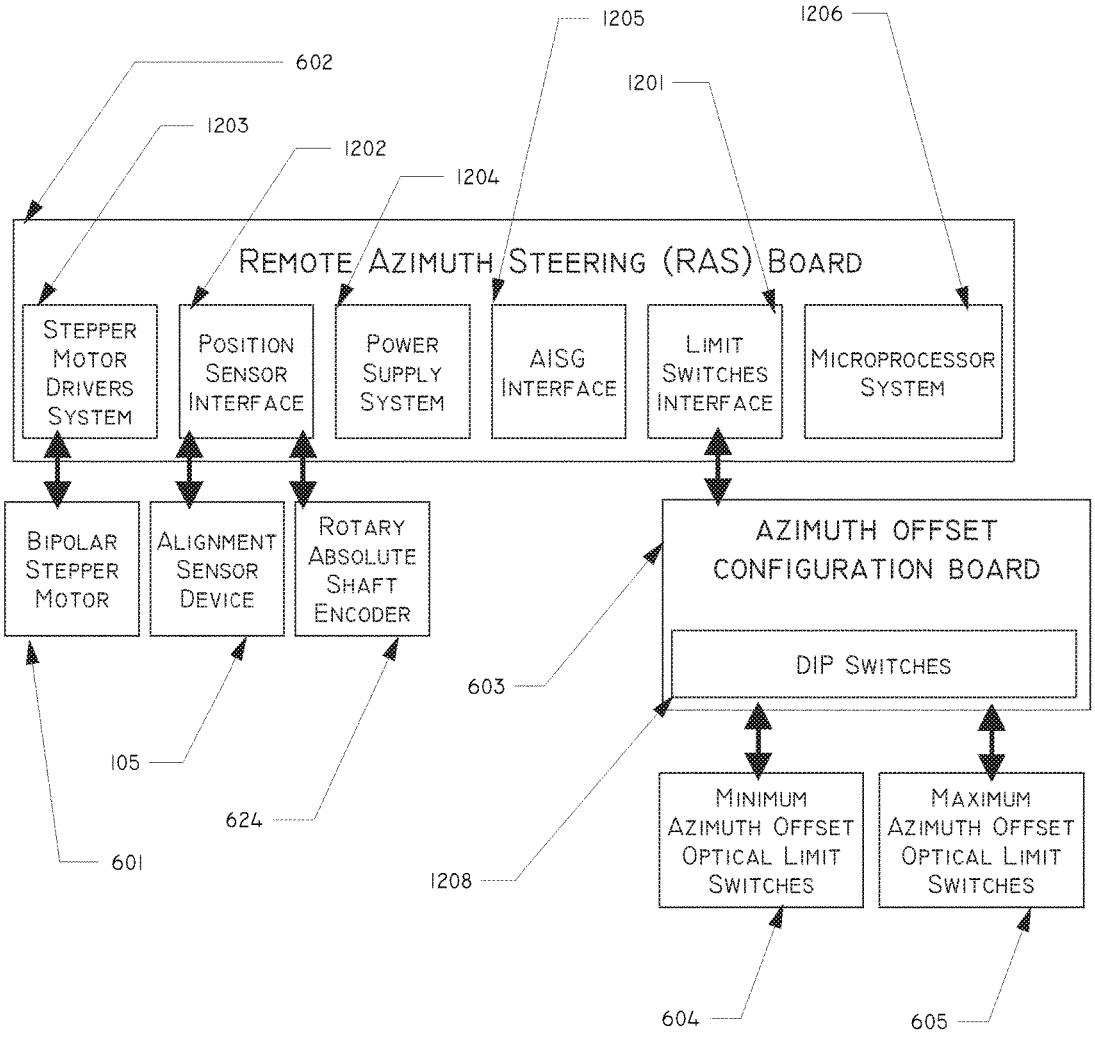
FIG. 12 is a block diagram of electronic components for remote azimuth steering according to one embodiment of the present invention.

FIG. 12 is a block diagram showing electronic components for the operation of the remote azimuth steering arrangement 103 according to one embodiment of the present invention. The Remote Azimuth Steering (RAS) board 602 holds the circuitry and components that enable remote azimuth steering, as well as manual operation without losing calibration between the motor and the antenna azimuth setting once user intervention is required. This circuitry and components may include a limit switches interface 1201, a position sensor interface 1202, a stepper motor drivers system 1203, a power supply system 1204, an antenna interface standards group (AISG) interface 1205, and a microprocessor system 1206.

The limit switches interface 1201 is used to restrict the output shaft disc rotary motion within specific boundaries. This interface 1201 is connected via an azimuth offset configuration board 603 to a set of normally-open minimum azimuth offset optical limit switches 604 and maximum azimuth offset optical limit switches 605 that are mounted on the lower top cover housing at predefined positions with respect to the output shaft disc alignment bore. The azimuth offset configuration board 603 provides configuration of the antenna array's allowable clockwise and counterclockwise rotational motion range. It comprises a plurality of toggle switches, preferably dual inline package switches (DIP switches) 1208, connected to the minimum azimuth offset optical limit switches 604 and the maximum azimuth offset optical limit switches 605. Thus, by setting a toggle switch to the appropriate position, the corresponding minimum and maximum azimuth offset optical limit switch 604 and 605 may be enabled or disabled. This is particularly desirable when uneven constraints for antenna array allowable clockwise and counterclockwise rotatable motion range must be satisfied.

The optical limit switches break the electrical connection when emitter beams of the minimum azimuth offset optical limit switches 604 and maximum azimuth offset optical limit switches 605 are blocked by the output shaft disc 626, in which case the antenna array 100 is within the allowable clockwise and counterclockwise rotational motion range. Similarly, the said normally-open minimum azimuth offset optical limit switches 604 and maximum azimuth offset optical limit switches 605 make the electrical connection when either a minimum azimuth offset limit slot 701 or a maximum azimuth offset slot 702 on the output shaft disc 626 is encountered, indicating that either the minimum azimuth offset or maximum azimuth offset has been reached.

As such, the RAS board microprocessor 1206 receives feedback on the aforementioned events. A denouncing resistor-capacitor (RC) network on each switch input clears any spikes produced when the switch contact closes, thus providing a clean edge for the microprocessor 1206.

The position sensor interface 1202 is used to receive feedback from the miniature rotary absolute shaft encoder 624 that is gear-coupled to the output shaft reporting accurate output shaft position to the RAS board microprocessor system 1206 over the allowable clockwise and counterclockwise rotational motion range without any intermittent stops. The encoder 624 analog output voltage ranges proportionally to the absolute shaft rotary angle from a minimum voltage to a maximum voltage over a maximum offset to minimum offset shaft rotation, having a high digital resolution output. The magnetic absolute position encoder 624 retains the output shaft position even after the event of a power loss, thus eliminating the need for re-calibration. Additionally, the position sensor interface 1202 is used to receive feedback from the Alignment Sensor Device (ASD) 105 that is mounted on the antenna mounting flange 507 to constantly monitor the tilt and roll of the antenna array 100 in real-time.

The stepper motor drivers system 1203 can operate high current and voltage bipolar stepper motors 601. Furthermore, it includes motion control with micro-stepping, thus enabling smooth and accurate acceleration, deceleration, speed and positioning. Its internal circuitry ensures recirculation and absorption of the Electromagnetic Field (EMF) currents induced by the motor's magnetic field, thus eliminating the need for bulky external diodes. The motor current is controlled by a reference voltage (VREF), provided by an external Digital to Analog Converter (DAC). The maximum current is closed-loop controlled for each step and for each motor winding independently by a sense voltage produced on a low impedance resistor. For each step two RC networks control the form of the rise and fall of the step, minimizing electromagnetic interference (EMI) phenomena and audible noise. With optimum design of those parameters, the motor steps very smoothly both in low and high speeds.

The power supply system 1204 comprises a switching power supply that is used to convert any input voltage ranging from 8V to 35V supplied through the AISG interface 1205 to the voltage required by the RAS unit peripherals. More specifically, the switching power supply provides the required voltage to the rotary absolute shaft encoders 624, the limit switches 604 and 605, the RS485 transceiver, as well as to a linear low dropout regulator. Furthermore, the use of a switching power supply eliminates board temperature rise that would otherwise occur using a simpler linear voltage regulator.

The AISG interface 1205 comprises a differential line transceiver suitable for high speed half-duplex data communication on multipoint bus transmission lines, designed for balanced data transmission and compliance with Electronic Industries Alliance (EIA) Standards RS-485, as well as a 10-30V and a DC return input. All AISG interface circuit lines are protected against surges with spark gaps. It should be noted that the board ground is isolated from the enclosure earth. The 10-30V power supply input passes through an inverse protection diode. This rail is used to supply power to the motor drivers as well as the switching power supply. The RS-485 transceiver is also connected the microprocessor universal asynchronous receiver/transmitter (UART) interface.

The microprocessor system 1206 includes a microprocessor and a set of peripheral chips including an Electrically Erasable Programmable Read-Only Memory (EEPROM) memory, a FLASH memory, a communications transceiver, a Real Time Clock (RTC) and a temperature sensor. Internally the microprocessor features an extensive set of peripherals, required for the motion functionality and the network communications. The microprocessor system 1206 is connected to the AISG Link network via an RS485 transceiver. The EEPROM memory is used to save the firmware registry including the RAS unit unique identification, device data, configuration data, calibration parameters, etc. The FLASH memory is used to store the firmware file upon a firmware upgrade. Once the file has been uploaded to the FLASH memory, the microprocessor can self-program with the new firmware. The RTC is used to provide date and time information to the RAS board unit 602. The temperature sensor can be used to measure the temperature and provide feedback to the firmware concerning the environmental conditions. An optional impedance termination of the line is available. The microprocessor UART interface is connected to the RS-485 transceiver. Since the link is half-duplex, the direction of the link is controlled by a RX or TX interface. The microprocessor UART supports very high baud rates; however the default rate is set to 9.6 kbps, as specified in the AISG standard.

Figure 13:
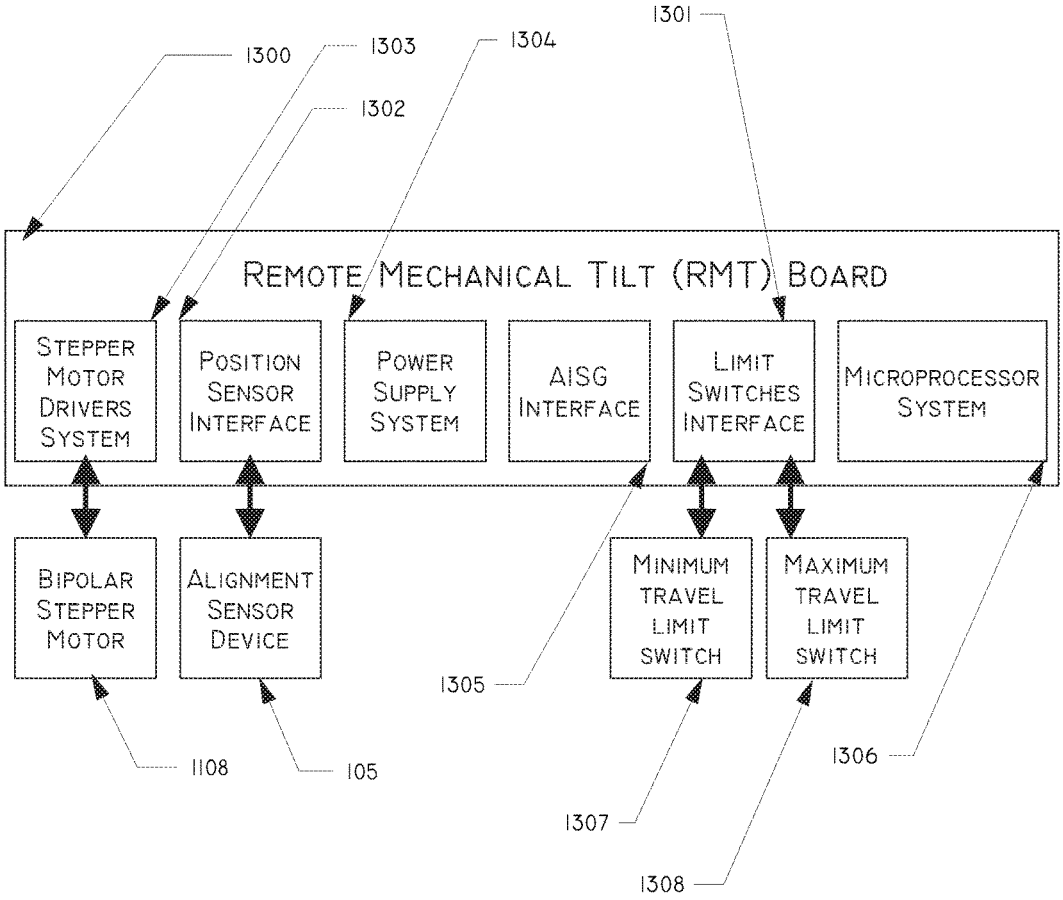
FIG. 13 is a block diagram of electronic components for remote electromechanical tilting according to another embodiment of the present invention.

FIG. 13 is a block diagram showing electronic components for the operation of the electromechanical remote tilt arrangement 104 according to one embodiment of the present invention. A Remote Mechanical Tilt (RMT) board 1300 holds the circuitry and components that enable remote mechanical tilt adjustment, as well as manual mechanical tilt operation without losing the calibration between the motor and the antenna mechanical tilt setting once user intervention is required. This circuitry and components may include a limit switches interface 1301, a position sensor interface 1302, a stepper motor drivers system 1303, a power supply system 1304, an antenna interface standards group (AISG) interface system 1305, and a microprocessor system 1306.

The limit switches interface 1301 is used to restrict the ball screw assembly travel within specific boundaries. This interface 1301 is connected to an integrated normally-open minimum travel limit switch 1307 and a maximum travel limit switch 1308, which are mounted on the ball screw assembly at predefined positions. The minimum travel limit switch 1307 is mounted at a position allowing the RMT board 1300 to identify the ball screw home position. Similarly, the maximum travel limit switch 1308 is mounted at a position allowing the RMT board 1300 to identify the ball screw end position. As such, the RMT board microprocessor system 1306 receives feedback on the aforementioned events. A denouncing resistor-capacitor (RC) network on each switch input clears any spikes produced when the switch contact closes, thus providing a clean edge for the microprocessor 1306.

The position sensor interface 1302 is used to receive feedback from the Alignment Sensor Device (ASD) 105 that is mounted on the antenna mounting flange 507 to constantly monitor the tilt and roll of the antenna array 100 in real-time.

The stepper motor drivers system 1303 can operate high current and voltage bipolar stepper motors 1108. Furthermore, it features motion control with micro-stepping, thus enabling smooth and accurate acceleration, deceleration, speed and positioning. Its internal circuitry ensures recirculation and absorption of the Electromagnetic Field (EMF) currents induced by the motor's magnetic field, thus eliminating the need for bulky external diodes. The motor current is controlled by a reference voltage (VREF), provided by an external Digital to Analog Converter (DAC). The maximum current is closed-loop controlled for each step and for each motor winding independently by a sense voltage produced on a low impedance resistor. For each step two RC networks control the form of the rise and fall of the step, minimizing electromagnetic interference (EMI) phenomena and audible noise. With optimum design of those parameters, the motor steps very smoothly both in low and high speeds.

The power supply system 1304 operates a switching power supply that is used to convert any input voltage ranging from 8V to 35V supplied through the AISG interface 1305 to the voltage required by the RMT unit peripherals. More specifically, the switching power supply provides the required voltage to the travel limit switches, the RS485 transceiver, as well as to a linear low dropout regulator and other components on the RMT board 1300. Furthermore, the use of a switching power supply eliminates board temperature rise that would otherwise occur using a simpler linear voltage regulator.

The AISG interface system 1305 comprises a differential line transceiver suitable for high speed half-duplex data communication on multipoint bus transmission lines, designed for balanced data transmission and compliance with Electronic Industries Alliance (ETA) Standards RS-485, as well as a 10-30V and a DC return input. All AISG interface circuit lines are protected against surges with spark gaps. It should be noted that the board ground is isolated from the enclosure earth. The 10-30V power supply input passes through an inverse protection diode. This rail is used to power supply the motor drivers as well as the switching power supply. The RS-485 transceiver is also connected the microprocessor universal asynchronous receiver/transmitter (UART) interface.

The microprocessor system 1306 consists of a microprocessor and a set of peripheral chips including an Electrically Erasable Programmable Read-Only Memory (EEPROM) memory, a FLASH memory, a communications transceiver, a Real Time Clock (RTC) and a temperature sensor. Internally the microprocessor features an extensive set of peripherals, required for the motion functionality and the network communications. The microprocessor system 1306 is connected to the AISG Link network via an RS485 transceiver.

The EEPROM memory is used to save the firmware registry including the RAS unit unique identification, device data, configuration data, calibration parameters, etc. The FLASH memory is used to store the firmware file upon a firmware upgrade. Once the file has been uploaded to the FLASH memory, the microprocessor can self-program with the new firmware. The RTC is used to provide date and time information to the RAS Unit. The temperature sensor can be used to measure the temperature and provide feedback to the firmware concerning the environmental conditions. An optional impedance termination of the line is available.

The microprocessor UART interface is connected to the RS-485 transceiver. Since the link is half-duplex, the direction of the link is controlled by a RX or TX interface. The microprocessor UART supports very high baud rates; however the default rate is set to 9.6 kbps, as specified in the AISG standard.

The present invention utilizes the two-way electromechanical function comprising a remote azimuth steering arrangement 103 and a remote mechanical tilt arrangement 104 to improve optimization of radio networks. Such optimization must be done frequently, especially as improved and enhanced mobile broadband network technology it deployed.

However, there are several issues with such optimization using currently-available antenna technology. Manual adjustment of the tilt angle of the mechanical electrical tilt (MET) antenna, and mechanical displacement of the antenna panel, requires that network engineers take several facts under consideration, such as weather conditions, site access limitations, specialized manpower or equipment etc. Moreover, during such adjustments, which can typically last several hours, the cell site is usually switched off for health and safety reasons. As a result, network service quality is degraded.

Consequently, under current technology, network operators tend to make fewer adjustments, and so networks are left operating sub-optimized, which also eventually results in lost revenue. Additionally, the high number of tunable network element parameters requiring manual configuration combined with the rapidly-changing network topologies and traffic patterns have recently highlighted the need for network self-organizing, thus alleviating operational expenses (OPEX) during network deployment and fine-tuning and leading to higher end user Quality of Experience (QoE).

Self-Organizing Networks (SON) solutions enable daily routine task automation, autonomous and swift network configuration, optimization and healing leading to user Quality of Service (QoS) enhancement. Nevertheless, SON optimization algorithms depend, amongst others, on the three-dimensional antenna orientation data, i.e. azimuth direction, mechanical tilt and roll, stored in the SON database. Thus, if the latter are not valid due to the use of inaccurate antenna alignment techniques, the network parameter changes output by the SON antenna based Coverage and Capacity Optimization (CCO) algorithm will be incorrect and may have a negative impact on the network performance. In addition to the optimization algorithm, a SON implementation should include a mechanism for dispatching parameter changes to Antenna Interface Standards Group (AISG) compatible antenna line devices (ALDs) incorporated in antenna systems providing remote electrical radiated beam steering for down-tilt, beam-width and azimuth, as well as remote mechanical antenna tilting. The antenna systems may be either be integrated into an antenna array, or in an antenna support structure.

The present invention overcomes these limitations, resulting in the delivery of fast and reliable mobile broadband connections, correct signal propagation, and accurate network coverage throughout an entire lifecycle of a mobile communications base station, and enabling antenna alignment and pattern changes to increase system capacity and allow for smooth network operation in time-varying traffic conditions.

Several aspects of the systems and methods of the present invention may be implemented in computing environments of many different configurations. For example, they may be implemented in conjunction with a special purpose computer, a programmed microprocessor or microcontroller and peripheral integrated circuit element(s), an ASIC or other integrated circuit, a digital signal processor, electronic or logic circuitry such as discrete element circuit, a programmable logic device or gate array such as a PLD, PLA, FPGA, PAL, and any comparable means. In general, any means of implementing the methodology illustrated herein can be used to implement the various aspects of the present invention. Exemplary hardware that can be used for the present invention includes computers, handheld devices, telephones (e.g., cellular, Internet enabled, digital, analog, hybrids, and others), and other such hardware. Some of these devices include processors (e.g., a single or multiple microprocessors), memory, nonvolatile storage, input devices, and output devices. Furthermore, alternative software implementations including, but not limited to, distributed processing, parallel processing, or virtual machine processing can also be configured to perform the methods described herein.

The systems and methods described herein may also be partially implemented in software that can be stored on a storage medium, executed on programmed general-purpose computer with the cooperation of a controller and memory, a special purpose computer, a microprocessor, or the like. In these instances, the systems and methods of this invention can be implemented as a program embedded on personal computer such as an applet, JAVA® or CGI script, as a resource residing on a server or computer workstation, as a routine embedded in a dedicated measurement system, system component, or the like. The system can also be implemented by physically incorporating the system and/or method into a software and/or hardware system.

Any data processing functions disclosed herein may be performed by one or more program instructions stored in or executed by such memory, and further may be performed by one or more modules configured to carry out those program instructions. Modules are intended to refer to any known or later developed hardware, software, firmware, artificial intelligence, fuzzy logic, expert system or combination of hardware and software that is capable of performing the data processing functionality described herein.

The foregoing descriptions of embodiments of the present invention have been presented for the purposes of illustration and description. It is not intended to be exhaustive or to limit the invention to the precise forms disclosed. Accordingly, many alterations, modifications and variations are possible in light of the above teachings, may be made by those having ordinary skill in the art without departing from the spirit and scope of the invention. It is therefore intended that the scope of the invention be limited not by this detailed description. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

Any claims included herewith are thus to be understood to include what is specifically illustrated and described above, what is conceptually equivalent, what can be obviously substituted and also what essentially incorporates the essential idea of the invention.

The invention claimed is:

1. An assembly for a mobile communications system, comprising:

an antenna array including one or more radiating elements;

a stationary backbone pole;

an antenna azimuth steering arrangement comprising a rotating pole, a plurality of bracket arms coupling the antenna array to the rotating pole, a steering drive unit linked to the rotating pole by a coupler at a lower end of the rotating pole, the steering drive unit configured to control movement of the rotating pole about the rotational portion of each linkage arm and, so as to electromechanically adjust an azimuthal angle of the antenna array relative to a reference axis and to prevent unintended movement of the rotating pole;

a mounting brace coupling the antenna azimuth steering arrangement to the stationary backbone pole;

an antenna tilting arrangement comprising a first telescopic mechanical tilt system attached to an upper end of the antenna array and to the rotating pole proximate to the rotational portion of a linkage arm at an upper end of the rotating pole by a first mounting clamp, a second telescopic mechanical tilt system attached to a lower end of the antenna array and to the rotating pole proximate to the rotational portion of a linkage arm at a lower end of the rotating pole by a second mounting clamp, the first and second telescopic mechanical tilt systems configured to adjust a tilt angle of the antenna array relative to the upper end of the rotating pole and to the lower end of the rotating pole, so as to electromechanically adjust the tilt angle of the antenna array relative to a reference plane and to prevent unintended movement of the antenna array; and an antenna orientation sensor that enables accurate alignment of the antenna array by measuring orientation parameters, and tilt and roll with respect to a horizontal plane.

2. The assembly of claim 1, wherein the antenna tilting arrangement and the antenna azimuth steering arrangement are remotely controllable to both electromechanically and manually adjust the azimuthal angle and the tilt angle independently and variably from each other.

3. The assembly of claim 1, wherein the rotating pole is coupled to the stationary backbone pole by the plurality of linkage arms and is configured to rotate about the rotational portion of the plurality of linkage arms.

4. The assembly of claim 1, wherein the steering drive unit includes an integrated motor and gearing assembly that allows both remote azimuth steering and manual operation without a calibration loss between a motor and an antenna azimuth setting once user intervention is required.

5. The assembly of claim 1, wherein the antenna azimuth steering arrangement further includes a speed reduction system to enable an antenna movement slow-down.

6. The assembly of claim 1, wherein the backbone pole and the rotating pole each have a spline twist prevention formation comprised of a plurality of regularly-spaced protrusions, and an alignment formation comprised of at least one protrusion having different dimensions than the spline twist prevention formation protrusions.

7. The assembly of claim 1, wherein the antenna tilting arrangement further includes a plurality of telescopic mechanisms that enable an antenna movement slow-down and horizontal translation of the antenna array, a profile rail guide mechanism for vertical translation of the antenna array, a hinged attachment block for pivotal translation of the antenna array, and an electromechanical drive system to enable the antenna movement slow-down.

8. An apparatus comprising:

a mobile network communications array including a plurality of antenna elements for directing a beam of electromagnetic energy in a desired propagation direction and at a desired inclination; and a bracket assembly for supporting and positioning the plurality of antenna elements to independently and variably achieve the desired propagation direction and the desired inclination, the bracket assembly including at least one of:

an antenna tilt system configured to electromechanically or manually adjust both an upper end bracket arm and a lower end bracket arm of the mobile network communications array relative to a reference plane to shape an antenna radiation pattern, an azimuth angle steering system configured to electromechanically or manually adjust an azimuth angle of the mobile network communications array by rotating the rotating pole relative to a reference axis to shape the antenna radiation pattern, the azimuth angle steering system including a steering drive unit having an integrated motor and gearing assembly that allows both remote azimuth steering and manual operation without a calibration loss between a motor and an antenna azimuth setting once user intervention is required, and wherein the bracket assembly comprises a stationary backbone pole, a rotating pole, wherein the stationary backbone pole and the rotating pole each have a spline twist prevention formation comprised of a plurality of regularly-spaced protrusions, and an alignment formation comprised of at least one protrusion having different dimensions than the spline twist prevention formation protrusions.

9. The apparatus of claim 8, wherein the bracket assembly comprises the stationary backbone pole, the rotating pole, a mounting brace, a plurality of linkage arms each having a rotational portion and a stationary portion, and the upper end and lower end bracket arms to form a support structure for the mobile network communications array.

10. The apparatus of claim 8, wherein the antenna tilting system includes a drive unit configured to tilt the mobile network communications array relative to a reference plane to achieve the desired inclination, and speed reduction components to enable an antenna tilt slow-down.

11. The apparatus of claim 8, wherein the azimuth steering drive unit is coupled to the rotating pole and configured to control movement of the rotating pole to achieve the desired propagation direction of the mobile network communications array relative to a reference axis, and includes speed reduction components to enable an antenna rotation slow-down.

12. The apparatus of claim 8, wherein the bracket assembly further comprises an integrated antenna orientation sensor that enables accurate alignment of the antenna array by measuring orientation parameters, and tilt and roll with respect to a horizontal plane.

13. A method of adjusting an inclination and direction of an antenna array in a mobile communications network, comprising:

adjusting a tilt angle of an antenna array at both an upper end bracket arm and a lower end bracket arm of an assembly coupling the antenna array to a support structure, and relative to a reference plane, to shape an antenna radiation pattern and direct a beam of electromagnetic energy at a desired inclination by horizontal, vertical and pivotal displacement of the assembly, where an antenna tilting arrangement comprises a first telescopic mechanical tilt system attached to an upper end of the antenna array and to a rotating pole proximate to a rotational portion of a linkage arm at an upper end of the rotating pole by a first mounting clamp, a second telescopic mechanical tilt system attached to a lower end of the antenna array and to the rotating pole proximate to the rotational portion of a linkage arm at a lower end of the rotating pole by a second mounting clamp, the first and second telescopic mechanical tilt systems configured perform the adjusting the tilt angle of the antenna array relative to the upper end of the rotating pole and to the lower end of the rotating pole, so as to electromechanically adjust the tilt angle of the antenna array to prevent unintended movement of the antenna array;

adjusting an azimuth angle of the antenna array by rotating a the rotating pole relative to a reference axis, to shape the antenna radiation pattern and direct a beam of electromagnetic energy in a desired propagation direction; and steering a tilting movement of the antenna array relative to the reference plane by a tilting drive unit, and a rotational movement of the rotating pole by an azimuth steering drive unit, to independently and variably achieve the desired propagation direction and the desired inclination.

14. The method of claim 13, wherein the azimuth steering drive unit includes an integrated motor and gearing assembly that allows both remote azimuth steering and manual operation without a calibration loss between a motor and an antenna azimuth setting once user intervention is required.

15. The method of claim 13, further comprising adjusting a speed of the tilting movement and adjusting a speed of the rotational movement to achieve an antenna tilt slow-down and an antenna rotation slow-down.

16. The method of claim 13, further comprising accurately aligning the antenna array with an integrated antenna orientation sensor.

17. The method of claim 16, wherein the accurately aligning the antenna array further comprises measuring orientation parameters, and tilt and roll with respect to a horizontal plane.

* * * * *